US011854509B2

(12) United States Patent
Yuan et al.

(10) Patent No.: US 11,854,509 B2
(45) Date of Patent: Dec. 26, 2023

(54) DISPLAY SUBSTRATE AND DRIVING METHOD CONDUCIVE TO REDUCE TOTAL NUMBER OF GATE SCAN LINES NARROWING BEZEL OF DISPLAY SUBSTATE

(71) Applicants: Hefei BOE Joint Technology Co.,Ltd., Anhui (CN); BOE TECHNOLOGY GROUP CO., LTD., Beijing (CN)

(72) Inventors: Can Yuan, Beijing (CN); Yongqian Li, Beijing (CN); Zhidong Yuan, Beijing (CN)

(73) Assignees: Hefei BOE Joint Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/802,776

(22) PCT Filed: Oct. 13, 2021

(86) PCT No.: PCT/CN2021/123630

§ 371 (c)(1),
(2) Date: Aug. 26, 2022

(87) PCT Pub. No.: WO2022/111101

PCT Pub. Date: Jun. 2, 2022

(65) Prior Publication Data

US 2023/0080385 A1 Mar. 16, 2023

(30) Foreign Application Priority Data

Nov. 25, 2020 (CN) ..... 202011339522.6

(51) Int. Cl.
*G09G 3/36* (2006.01)

(52) U.S. Cl.
CPC ..... *G09G 3/3677* (2013.01); *G09G 3/3688* (2013.01); *G09G 2300/0842* (2013.01);
(Continued)

(58) Field of Classification Search
CPC ..... G09G 3/30; G09G 3/32; G09G 3/3208; G09G 3/3216; G09G 3/3225;
(Continued)

(56) References Cited

U.S. PATENT DOCUMENTS

2008/0036710 A1* 2/2008 Kim ..... G09G 3/3233 345/82
2009/0108763 A1* 4/2009 Han ..... G09G 3/3233 315/169.3

(Continued)

FOREIGN PATENT DOCUMENTS

CN 1731503 A 2/2006
CN 102778794 A 11/2012

(Continued)

OTHER PUBLICATIONS

Office Action for Chinese Patent Application No. 202011339522.6 issued by the Chinese Patent Office dated Dec. 14, 2021.
Office Action for Chinese Patent Application No. 202011339522.6 issued by the Chinese Patent Office dated Jul. 26, 2022.
Decision of Rejection for Chinese Patent Application No. 202011339522.6 issued by the Chinese Patent Office dated Dec. 15, 2022.

*Primary Examiner* — Amit Chatly
*Assistant Examiner* — Nelson Lam
(74) *Attorney, Agent, or Firm* — IP & T GROUP LLP

(57) ABSTRACT

A display substrate has a display area and a peripheral area. The display substrate includes a plurality of sub-pixels, a plurality of groups of gate scan signal lines, and a plurality of groups of data lines. Each group of gate scan signal lines includes at least one gate scan signal line, each group of data lines includes n data lines, and the plurality of sub-pixels are arranged in an array; and n is greater than or equal to 2. A group of gate scan signal lines is electrically connected to n
(Continued)

rows of sub-pixels. A column of sub-pixels is electrically connected to a group of data lines, and includes a plurality of groups of sub-pixels. Each group of sub-pixels includes n sub-pixels. The n sub-pixels are respectively electrically connected to n data lines in the group of data lines to which this column of sub-pixels is electrically connected.

14 Claims, 11 Drawing Sheets

(52) U.S. Cl.
CPC ..... *G09G 2310/0278* (2013.01); *G09G 2310/0286* (2013.01); *G09G 2310/061* (2013.01)

(58) Field of Classification Search
CPC .. G09G 3/3233; G09G 3/3241; G09G 3/3258; G09G 3/3266; G09G 3/3275; G09G 3/3283; G09G 3/3291; G09G 3/36; G09G 3/3611; G09G 3/3614; G09G 3/3622; G09G 3/3625; G09G 3/3674; G09G 3/364; G09G 3/3644; G09G 3/3648; G09G 3/3677; G09G 3/3681
USPC ..... 345/76–83, 87–104
See application file for complete search history.

(56) References Cited

U.S. PATENT DOCUMENTS

| | | | | |
|---|---|---|---|---|
| 2009/0109150 | A1* | 4/2009 | Han | G09G 3/3266 345/82 |
| 2012/0176421 | A1* | 7/2012 | Asano | H10K 59/131 345/690 |
| 2014/0111406 | A1 | 4/2014 | Wang et al. | |
| 2016/0042691 | A1* | 2/2016 | Na | G11C 19/28 345/82 |
| 2018/0068622 | A1 | 3/2018 | Guo | |
| 2018/0069190 | A1 | 3/2018 | Kim et al. | |
| 2018/0308427 | A1 | 10/2018 | Zhang et al. | |

FOREIGN PATENT DOCUMENTS

| | | | |
|---|---|---|---|
| CN | 103065556 | A | 4/2013 |
| CN | 106128360 | A | 11/2016 |
| CN | 107799535 | A | 3/2018 |
| CN | 109637482 | A | 4/2019 |
| CN | 112435622 | A | 3/2021 |
| JP | 2016-38402 | A | 3/2016 |

* cited by examiner

DISPLAY SUBSTRATE AND DRIVING METHOD CONDUCIVE TO REDUCE TOTAL NUMBER OF GATE SCAN LINES NARROWING BEZEL OF DISPLAY SUBSTATE

CROSS-REFERENCE TO RELATED APPLICATIONS

This application is a national phase entry under 35 USC 371 of International Patent Application No. PCT/CN 2021/123630 filed on Oct. 13, 2021, which claims priority to Chinese Patent Application No. 202011339522.6, filed on Nov. 25, 2020, which are incorporated herein by reference in their entirety.

TECHNICAL FIELD

The present disclosure relates to the field of display technologies, and in particular, to a display substrate and a driving method therefor, and a display device.

BACKGROUND

In the field of display technologies, the gate diver on array (GOA) technology is a technology in which gate scan driving circuit(s) are manufactured on a side or two sides of an effective display area of an array substrate. Compared with a traditional gate driving circuit chip, the GOA technology is able to effectively reduce an area of a bezel, so as to realize narrow-bezel display.

SUMMARY

In an aspect, a display substrate is provided. The display substrate has a display area and a peripheral area located on at least one side of the display area. The display substrate includes a plurality of sub-pixels, a plurality of groups of gate scan signal lines and a plurality of groups of data lines that are all disposed in the display area. Each group of gate scan signal lines includes at least one gate scan signal line, each group of data lines includes n data lines, and the plurality of sub-pixels are arranged in an array; n is greater than or equal to 2. A group of gate scan signal lines is electrically connected to n rows of sub-pixels. A column of sub-pixels is electrically connected to a group of data lines. The column of sub-pixels includes a plurality of groups of sub-pixels, and each group of sub-pixels includes n sub-pixels. The n sub-pixels are respectively electrically connected to n data lines in the group of data lines to which this column of sub-pixels is electrically connected.

In some embodiments, every n adjacent rows of sub-pixels are electrically connected to a group of gate scan signal lines. In the column of sub-pixels, the n sub-pixels included in each group of sub-pixels are n adjacent sub-pixels. An i-th sub-pixel in the n sub-pixels is electrically connected to an i-th data line in the n data lines to which this column of sub-pixels is electrically connected, and i is greater than or equal to 1 and less than or equal to n.

In some embodiments, the group of gate scan signal lines is electrically connected to two adjacent rows of sub-pixels. The column of sub-pixels is electrically connected to two data lines. In the column of sub-pixels, an odd-numbered sub-pixel is electrically connected to one of the two data lines, and an even-numbered sub-pixel is electrically connected to another one of the two data lines.

In some embodiments, each group of gate scan signal lines is disposed between two adjacent rows of sub-pixels to which this group of gate scan signal lines is electrically connected.

In some embodiments, the at least one gate scan signal line includes two to four gate scan signal lines. Each gate scan signal line is electrically connected to corresponding n rows of sub-pixels.

In some embodiments, each sub-pixel includes a pixel driving circuit. The group of gate scan signal lines is electrically connected to pixel driving circuits in the n rows of sub-pixels, and the group of data lines is electrically connected to pixel driving circuits in the column of sub-pixels. The pixel driving circuit includes a data writing sub-circuit. The data writing sub-circuit is electrically connected to a gate scan signal line in a group of gate scan signal lines to which the sub-pixel is electrically connected, and a data line in a group of data lines to which the sub-pixel is electrically connected. The data writing sub-circuit is configured to write a data signal received at the data line into the pixel driving circuit under a control of a gate scan signal transmitted by the gate scan signal line.

In some embodiments, the display substrate further includes a plurality of first voltage signal lines, a plurality of second voltage signal lines and a plurality of initialization signal lines that are all disposed in the display area. Each group of gate scan signal lines includes a first gate scan signal line, a second gate scan signal line, a third gate scan signal line and a fourth gate scan signal line. The first gate scan signal line, the second gate scan signal line, the third gate scan signal line and the fourth gate scan signal line are electrically connected to corresponding n rows of sub-pixels. The pixel driving circuit in each sub-pixel is electrically connected to a first voltage signal line, a second voltage signal line, an initialization signal line, the first gate scan signal line, the second gate scan signal line, the third gate scan signal line and the fourth gate scan signal line. The sub-pixel further includes a light-emitting device electrically connected to the pixel driving circuit.

In some embodiments, the pixel driving circuit further includes a first reset sub-circuit, a second reset sub-circuit, a driving sub-circuit, a light-emitting control sub-circuit and a storage sub-circuit. The first reset sub-circuit is electrically connected to a first node, the initialization signal line and the second gate scan signal line. The first reset sub-circuit is configured to transmit an initialization signal received at the initialization signal line to the first node under a control of a second gate scan signal transmitted by the second gate scan signal line. The second reset sub-circuit is electrically connected to the first voltage signal line, a second node and the fourth gate scan signal line. The second reset sub-circuit is configured to transmit a first voltage signal received at the first voltage signal line to the second node under a control of a fourth gate scan signal transmitted by the fourth gate scan signal line.

The gate scan signal line to which the data writing sub-circuit is electrically connected is the first gate scan signal line, and the data writing sub-circuit is further electrically connected to a third node. The data writing sub-circuit is configured to transmit the data signal received at the data line to the third node under a control of a first gate scan signal transmitted by the first gate scan signal line. The driving sub-circuit is electrically connected to the second node, the third node, a fourth node and the second gate scan signal line. The driving sub-circuit is configured to: transmit the first voltage signal at the second node to the fourth node under the control of the second gate scan signal transmitted by the second gate scan signal line; and transmit the data signal at the third node to the fourth node, and generate and transmit a driving current to the third node under a control of a voltage of the fourth node.

The storage sub-circuit is electrically connected to the first node and the fourth node. The storage sub-circuit is configured to store the voltage of the fourth node and a voltage of the first node, and to change a potential of the fourth node due to an action of the voltage of the first node. The light-emitting control sub-circuit is electrically connected to the first node, the third node and the third gate scan signal line. The light-emitting control sub-circuit is configured to transmit the driving current received at the third node to the first node under a control of a third gate scan signal transmitted by the third gate scan signal line. The light-emitting device is electrically connected to the first node and the second voltage signal line. The light-emitting device is configured to emit light under a control of the driving current received at the first node.

In some embodiments, the first reset sub-circuit includes a first transistor. A control electrode of the first transistor is electrically connected to the second gate scan signal line, a first electrode of the first transistor is electrically connected to the initialization signal line, and a second electrode of the first transistor is connected to the first node. The second reset sub-circuit includes a second transistor. A control electrode of the second transistor is electrically connected to the fourth gate scan signal line, a first electrode of the second transistor is electrically connected to the first voltage signal line, and a second electrode of the second transistor is electrically connected to the second node.

The data writing sub-circuit includes a third transistor. A control electrode of the third transistor is electrically connected to the first gate scan signal line, a first electrode of the third transistor is electrically connected to the data line, and a second electrode of the third transistor is electrically connected to the third node. The driving sub-circuit includes a fourth transistor and a fifth transistor. A control electrode of the fourth transistor is electrically connected to the fourth node, a first electrode of the fourth transistor is electrically connected to the second node, and a second electrode of the fourth transistor is electrically connected to the third node. A control electrode of the fifth transistor is electrically connected to the second gate scan signal line, a first electrode of the fifth transistor is electrically connected to the second node, and a second electrode of the fifth transistor is electrically connected to the fourth node.

The storage sub-circuit includes a storage capacitor. A first electrode of the storage capacitor is electrically connected to the fourth node, and a second electrode of the storage capacitor is electrically connected to the first node. The light-emitting control sub-circuit includes a sixth transistor. A control electrode of the sixth transistor is electrically connected to the third gate scan signal line, a first electrode of the sixth transistor is electrically connected to the third node, and a second electrode of the sixth transistor is electrically connected to the first node. A first electrode of the light-emitting device is electrically connected to the first node, and a second electrode of the light-emitting device is electrically connected to the second voltage signal line.

In some embodiments, the display substrate further includes at least one gate driving circuit disposed in the peripheral area. Each gate driving circuit includes a plurality of shift registers, and each shift register is electrically connected to at least one gate scan signal line in a group of gate scan signal lines.

In some embodiments, in a case where each group of gate scan signal lines includes four gate scan signal lines, the at least one gate driving circuit includes four gate driving circuits, and a shift register in each gate driving circuit is electrically connected to a gate scan signal line in the four gate scan signal lines; or the at least one gate driving circuit includes three gate driving circuits, and a shift register in one gate driving circuit of the three gate driving circuits is electrically connected to two gate scan signal lines in the four gate scan signal lines; and in another two of the three gate driving circuits, a shift register in each gate driving circuit is electrically connected to one of another two gate scan signal lines in the four gate scan signal lines.

In some embodiments, the display substrate further includes a plurality of data selectors disposed in the peripheral area. Each data selector is electrically connected to n data lines to which a column of sub-pixels is electrically connected.

In another aspect, a display device is provided. The display device includes the display substrate in any one of the above embodiments.

In some embodiments, the display device further includes a source driver electrically connected to the plurality of groups of data lines in the display substrate.

In yet another aspect, a driving method of a display substrate is provided. The driving method is used for driving the display substrate in any one of the above embodiments, and n rows of sub-pixels to which each group of gate scan signal lines is electrically connected are a driving unit. The driving method of the display substrate includes: transmitting, via each group of gate scan signal lines, gate scan signals to the n rows of sub-pixels included in the driving unit to which this group of gate scan signal lines is electrically connected, so that n rows of sub-pixels included in each driving unit operate synchronously under a control of the gate scan signals; and sequentially controlling, via the plurality of groups of gate scan signal lines, sub-pixels in a plurality of driving units to operate.

In some embodiments, the shift register in the one gate driving circuit outputs two identical signals. The shift register in the one gate driving circuit is directly electrically connected to one of the two gate scan signal lines, and is electrically connected to another one of the two gate scan signal lines through an inverter.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art may obtain other drawings according to these accompanying drawings. In addition, the accompanying drawings in the following description may be regarded as schematic diagrams, and are not limitations on an actual size of a product, an actual process of a method, and an actual timing of a signal involved in the embodiments of the present disclosure.

DETAILED DESCRIPTION

Figure 1:
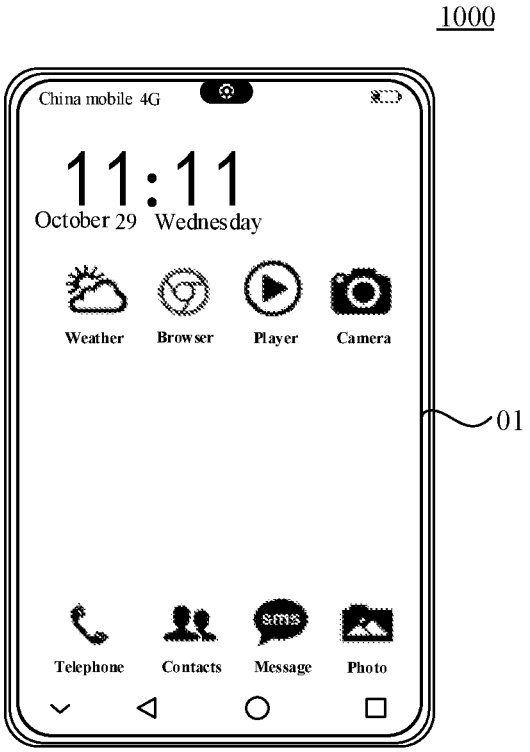
FIG. 1 is a structural diagram of a display device, in accordance with some embodiments.

Technical solutions in some embodiments of the present disclosure will be described clearly and completely below with reference to the accompanying drawings. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "an example," "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms such as "first" and "second" are only used for descriptive purposes, and are not to be construed as indicating or implying relative importance or implicitly indicating the number of indicated technical features. Thus, a feature defined with "first" or "second" may explicitly or implicitly include one or more of the features. In the description of the embodiments of the present disclosure, the term "a plurality of/the plurality of" means two or more unless otherwise specified.

In the description of some embodiments, the terms such as "coupled" and "connected" and extensions thereof may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The use of the phase "applicable to" or "configured to" herein means an open and inclusive expression, which does not exclude devices that are applicable to or configured to perform additional tasks or steps.

In addition, the use of the phase "based on" means openness and inclusiveness, since a process, step, calculation or other action that is "based on" one or more stated conditions or values may, in practice, be based on additional conditions or values exceeding those stated.

As shown in FIG. 1, some embodiments of the present disclosure provide a display device 1000. The display device may be, for example, a mobile phone, a tablet computer, a personal digital assistant (PDA), a television, a vehicle-mounted computer, or a wearable display device such as a watch. The specific form of the display device is not particularly limited in the embodiments of the present disclosure.

In some examples, the display device may be a liquid crystal display (LCD) device; or the display device may be an electroluminescent display device ora photoluminescent display device. In a case where the display device is the electroluminescent display device, the electroluminescent display device may be an organic light-emitting diode (OLED) display device or a quantum dot light-emitting diode (QLED) display device. In a case where the display device is the photoluminescent display device, the photoluminescent display device may be a quantum dot photoluminescent display device.

The display device includes a display substrate 01. For example, the display substrate may be a liquid crystal display substrate, or an organic light-emitting diode (OLED) display substrate.

As shown in FIGS. 2 to 7, the display substrate 01 includes a display area AA (i.e., active area; also referred to as an effective display area) and a peripheral area BB located on at least one side of the display area AA. For example, the peripheral area BB is arranged around the display area AA.

The display substrate 01 includes a plurality of sub-pixels 10, a plurality of gate scan signal lines G and a plurality of data lines D that are all disposed in the display area AA. The plurality of sub-pixels 10, the plurality of gate scan signal lines G and the plurality of data lines D are disposed on a base substrate 001. The plurality of gate scan signal lines G include a plurality of scan timing signal lines and a plurality of light-emitting timing signal lines. For example, the plurality of gate scan signal lines G extend along a horizontal direction X, and the plurality of data lines D extend along a vertical direction Y. The plurality of sub-pixels 10 are arranged in an array. For example, the plurality of sub-pixels 10 are arranged in N rows and M columns. In this case, sub-pixels 10 arranged in a line along the horizontal direction X are referred to as a row of sub-pixels, and sub-pixels 10 arranged in a line along the vertical direction Y are referred to as a column of sub-pixels.

Figure 2:
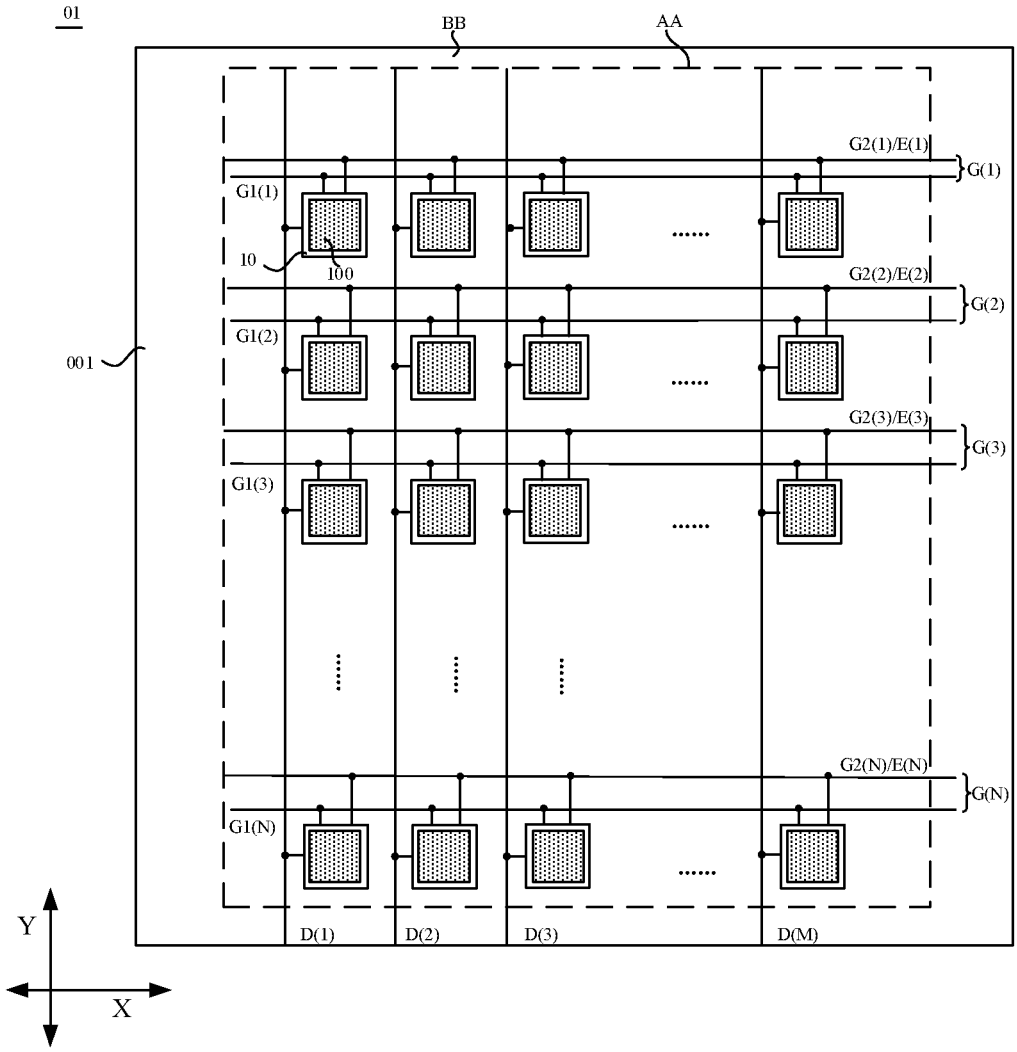
FIG. 2 is a structural diagram of a display substrate, in accordance with the related art.

In the related art, as shown in FIG. 2, a row of sub-pixels 10 may be coupled to one or more gate scan signal lines G, and a column of sub-pixels may be coupled to a data line D. Below, all gate scan signal line(s) coupled to the same row of sub-pixels are referred to as a group of gate scan signal lines (i.e., all gate scan signal line(s) in a brace in the figure are a group of gate scan signal lines). That is, a group of gate scan signal lines is coupled to a row of sub-pixels 10, so that in a case where the plurality of sub-pixels 10 are arranged in the N rows and the M columns, the display substrate 01 includes N groups of gate scan signal lines G(1) to G(N) and M data lines D(1) to D(M).

In some embodiments, the display substrate 01 further includes at least one gate driving circuit 20 disposed in the peripheral area BB, and the gate driving circuit(s) 20 are integrated in the display substrate 01 by gate driver on array (GOA). The gate driving circuit(s) 20 are electrically connected to the plurality of gate scan signal lines G, and are configured to implement a shift register function to drive the plurality of gate scan signal lines G by transmitting a plurality of gate scan signals to the plurality of gate scan signal lines row by row within a frame period.

Figure 3:
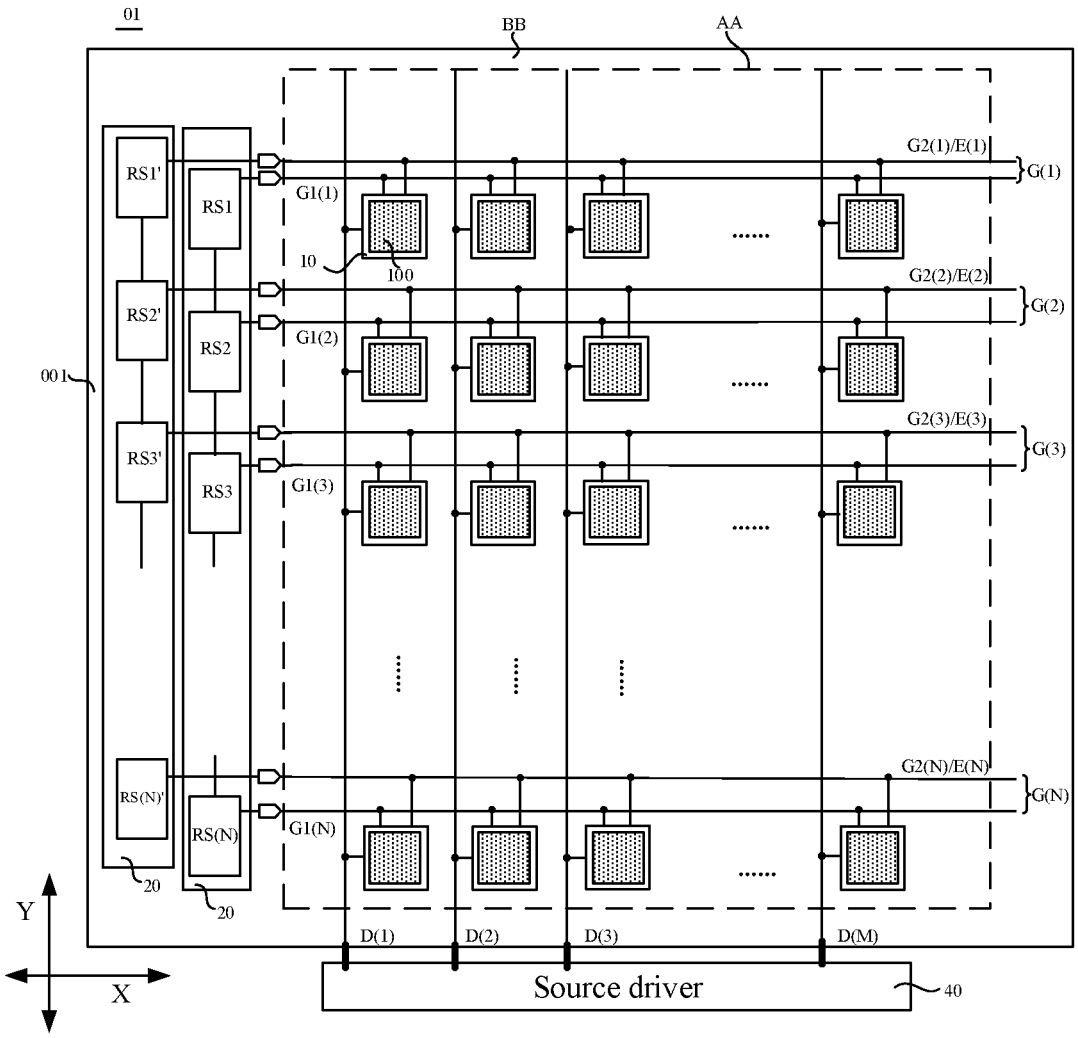
FIG. 3 is a structural diagram of another display substrate, in accordance with the related art.

As shown in FIG. 3, each gate driving circuit 20 includes a plurality of shift registers RS that are cascaded in sequence. Each shift register RS is electrically connected to one or two gate scan signal lines G. Each shift register RS corresponds to a row of sub-pixels 10, and is configured to output one or two gate scan signals corresponding to this row of sub-pixels 10. Thus, in a case where the display substrate 01 includes the N rows of sub-pixels 10 and the N groups of gate scan signal lines G, each gate driving circuit 20 includes N shift registers RS. The shift register is composed of a plurality of thin film transistors. In a case where the gate driving circuit includes a large number of shift registers, in order to ensure the stability of characteristics of the thin film transistors to enable the gate driving circuit to normally realize its function, a sufficient space is required to be reserved for arranging the thin film transistors and other structures included in the gate driving circuit, which results in a large area of a bezel region, and is to not conducive to an ultra-narrow bezel of the display substrate.

Figure 4:
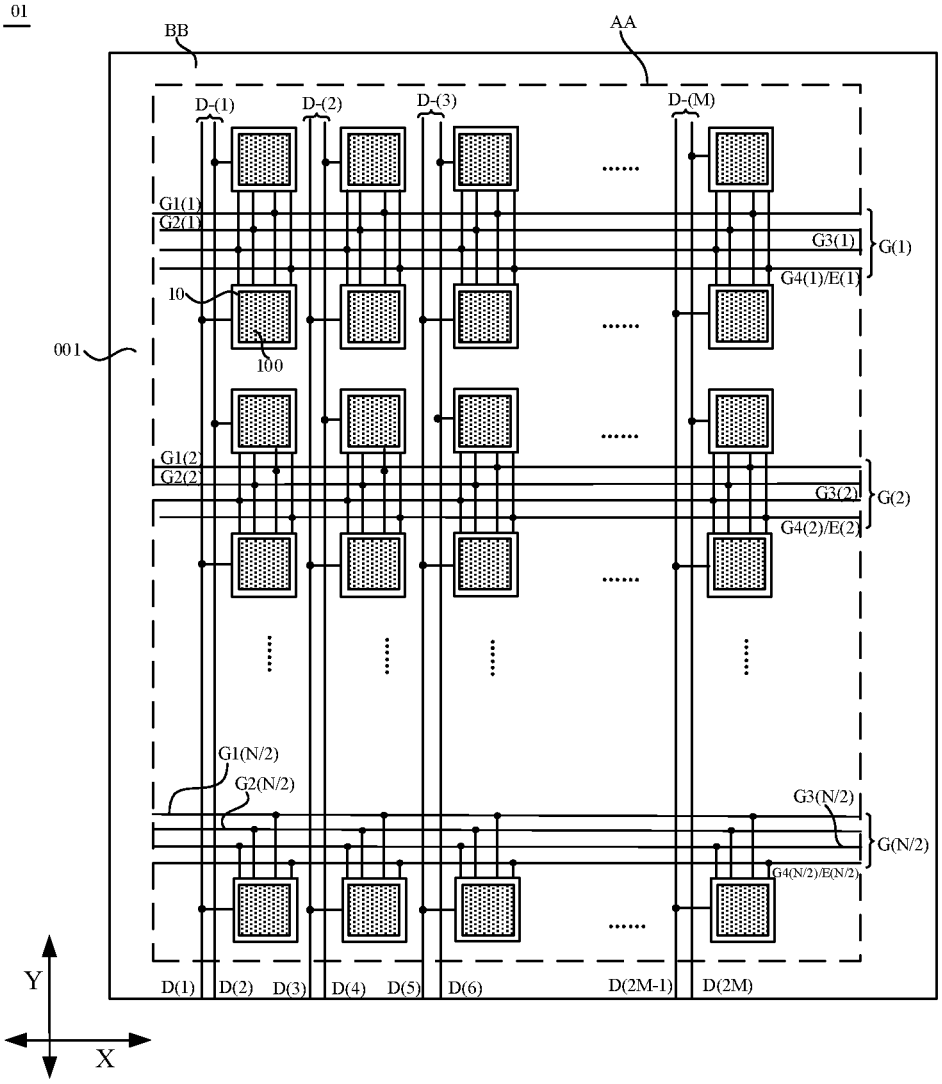
FIG. 4 is a structural diagram of a display substrate, in accordance with some embodiments of the present disclosure.
Figure 6:
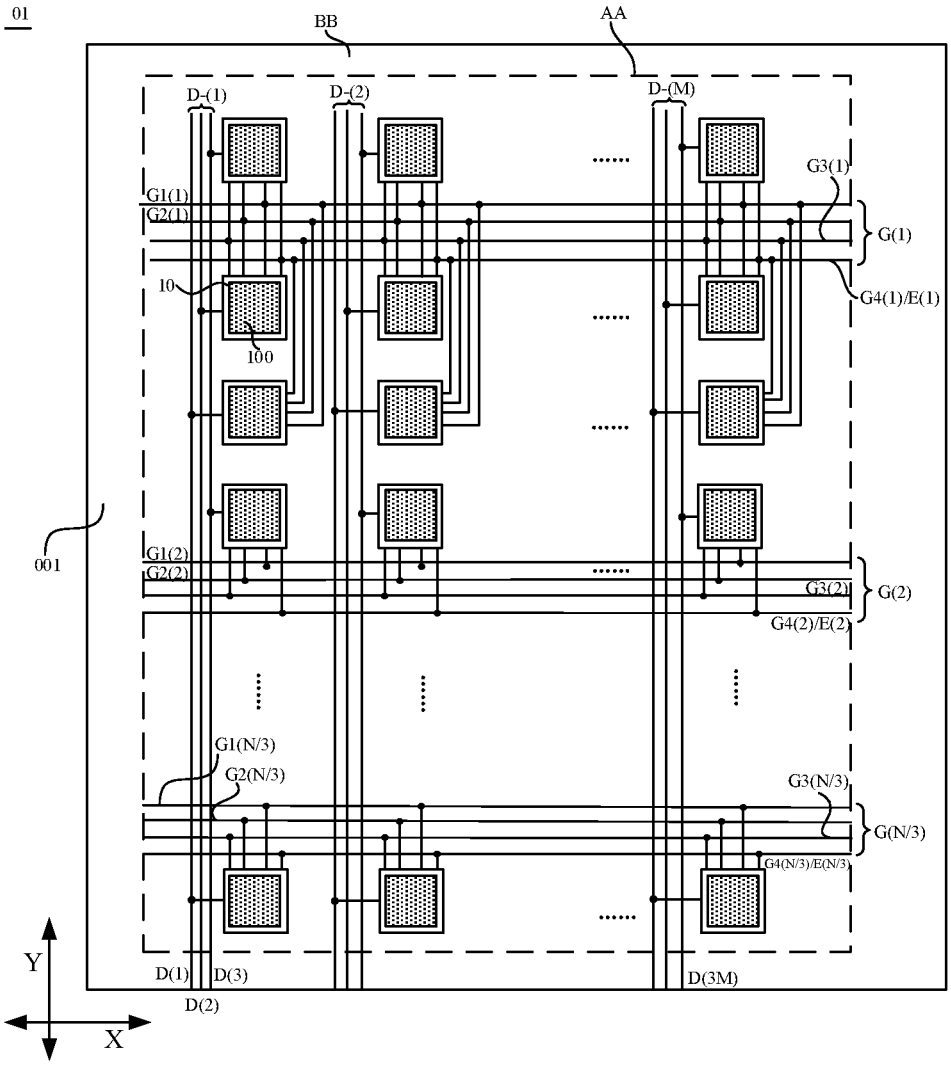
FIG. 6 is a structural diagram of yet another display substrate, in accordance with some embodiments of the present disclosure.

Based on this, as shown in FIGS. 4 and 6, the display substrate 01 is provided in embodiments of the present disclosure. In the display substrate 01, the plurality of gate scan signal lines G are divided into a plurality of groups, and the plurality of data lines D are divided into a plurality of groups. That is, the display substrate 01 includes the plurality of groups of gate scan signal lines and the plurality of groups of data lines. In FIG. 4 or 6, gate scan signal lines in a brace are a group of gate scan signal lines G(k), and data lines in a brace are a group of data lines D-(k'). Here, k is any positive integer between 1 and a maximum value of the group number of gate scan signal lines. Each group of gate scan signal lines includes at least one gate scan signal line, and each group of data lines includes n data lines, and n is greater than or equal to 2 (i.e., $n \geq 2$).

A group of gate scan signal lines G(k) is electrically connected to n rows of sub-pixels 10. That is, a group of gate scan signal lines G(k) is electrically connected to at least two rows of sub-pixels 10. For example, a group of gate scan signal lines G(k) may be electrically connected to two rows of sub-pixels 10, three rows of sub-pixels 10, or four rows of sub-pixels 10. Positional relationships between the n rows of sub-pixels 10 are not limited. For example, a group of gate scan signal lines G(k) is electrically connected to n adjacent rows of sub-pixels 10, or may be electrically connected to n spaced rows of sub-pixels 10.

A column of sub-pixels 10 is electrically connected to a group of data lines D-(k'). That is, a column of sub-pixels 10 is electrically connected to at least two data lines D. For example, a column of sub-pixels 10 may be electrically connected to two data lines D, three data lines D, or four data lines D. A group of data lines D-(k') to which a column of sub-pixels 10 is electrically connected is, for example, n adjacent data lines D.

A column of sub-pixels 10 includes a plurality of groups of sub-pixels, and each group of sub-pixels includes n sub-pixels. The n sub-pixels are respectively electrically connected to n data lines in a group of data lines D-(k') to which this column of sub-pixels is electrically connected.

The n sub-pixels included in each group of sub-pixels are electrically connected to the same group of gate scan signal lines G(k), and the n sub-pixels are electrically connected to the n data lines in the group of data lines D-(k') to which this column of sub-pixels are electrically connected in one-to-one correspondence.

For example, as shown in FIG. 4, in a case where n is 2, each group of data lines includes two data lines. For example, a first group of data lines D-(1) includes a data line D(1) and a data line D(2). A group of gate scan signal lines G(k) is electrically connected to two rows of sub-pixels 10. For example, a first group of gate scan signal lines G(1) is electrically connected to a first row of sub-pixels 10 and a second row of sub-pixels 10. A column of sub-pixels 10 is electrically connected to a group of data lines D-(k'). A column of sub-pixels includes a plurality of groups of sub-pixels, and each group of sub-pixels includes two sub-pixels. The two sub-pixels are electrically connected to the same group of gate scan signal lines G(k), and are respectively electrically connected to two data lines in a group of data lines D-(k') to which this column of sub-pixels is electrically connected. In this case, the display substrate includes N/2 groups of gate scan signal lines.

Alternatively, as shown in FIG. 6, in a case where n is 3, each group of data lines includes three data lines. For example, the first group of data lines D-(1) includes the data line D(1), the data line D(2) and a data line D(3). A group of gate scan signal lines G(k) is electrically connected to three rows of sub-pixels 10. For example, the first group of gate scan signal lines G(1) is electrically connected to the first row of sub-pixels 10, the second row of sub-pixels 10 and a third row of sub-pixels 10. A column of sub-pixels 10 is electrically connected to a group of data lines D-(k'). A column of sub-pixels includes a plurality of groups of sub-pixels, and each group of sub-pixels includes three sub-pixels. The three sub-pixels are electrically connected to the same group of gate scan signal lines G(k). The three sub-pixels are respectively electrically connected to three data lines in a group of data lines D-(k') to which this column of sub-pixels is electrically connected. In this case, the display substrate includes N/3 groups of gate scan signal lines.

In this way, every n rows of sub-pixels 10 are turned on under a control of the same group of gate scan signal lines G(k), and the plurality of data lines D write data signals into corresponding sub-pixels 10, so that the n rows of sub-pixels 10 operate synchronously. In a frame period, the plurality groups of gate scan signal lines control respective n rows of sub-pixels to work in sequence, so as to light up all the sub-pixels to display an image.

In the display substrate provided in some embodiments of the present disclosure, a group of gate scan signal lines G(k) is electrically connected to n rows of sub-pixels, and controls the n rows of sub-pixels synchronously, and each column of sub-pixels is electrically connected to a group of data lines D-(k'), so that each sub-pixel is written with a corresponding data signal. In this way, on a premise of ensuring a normal display of a display image, the number of gate scan signal lines is able to be reduced by enabling a group of gate scan signal lines G(k) to synchronously control n rows of sub-pixels, thereby reducing the number of shift registers correspondingly electrically connected to the gate scan signal lines. For example, in the case where the plurality of sub-pixels are arranged in the N rows and the M columns, by coupling a group of gate scan signal lines G(k) to a row of sub-pixels in the related art, N groups of gate scan signal lines are required, so that the total number of the gate scan signal lines is large. However, by using the connections provided in some embodiments of the present disclosure, N/n groups of gate scan signal lines are required for the N rows of sub-pixels, so that the total number of the gate scan signal lines is reduced, and the number of shift registers included in the gate driving circuit is reduced, which is conducive to narrowing the bezel of the display substrate to improve a screen-to-body ratio of the display substrate and the display effect.

In some embodiments, as shown in FIGS. 4 to 7, every n adjacent rows of sub-pixels are electrically connected to a group of gate scan signal lines G(k). In a column of sub-pixels 10, n sub-pixels 10 included in each group of sub-pixels 10 are n adjacent sub-pixels 10, and an i-th sub-pixel 10 in the n sub-pixels 10 is electrically connected to an i-th data line in n data lines to which this column of sub-pixels 10 is electrically connected. Here, i is greater than or equal to 1 and less than or equal to n (i.e., $1 \leq i \leq n$).

Figure 7:
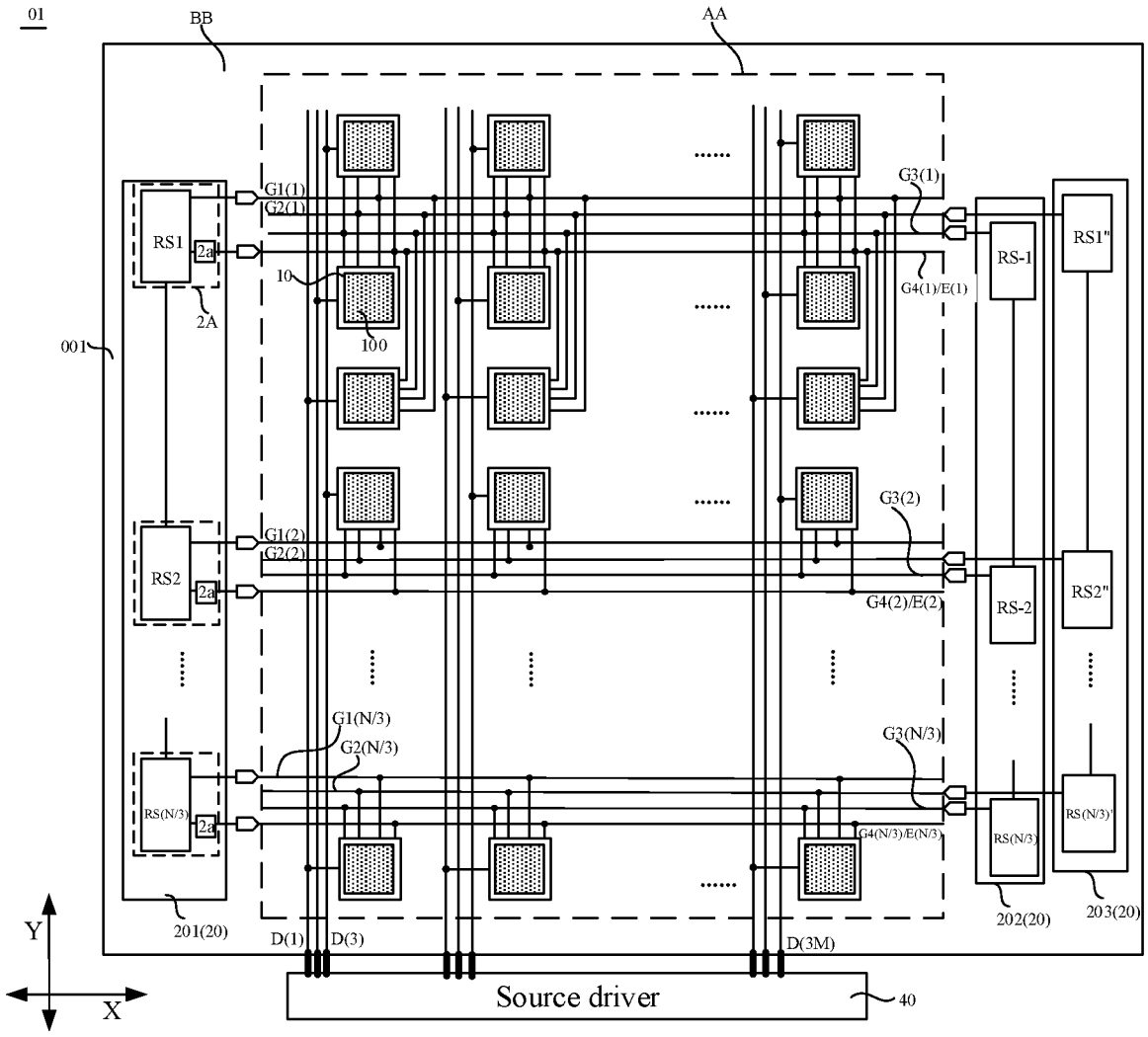
FIG. 7 is a structural diagram of yet another display substrate, in accordance with some embodiments of the present disclosure.

For example, as shown in FIGS. 6 and 7, in the case where n is 3, each group of data lines D-(k') includes three data lines D, every three adjacent rows of sub-pixels 10 are a driving unit, and a group of gate scan signal lines G(k) is electrically connected to three adjacent rows of sub-pixels 10. A column of sub-pixels 10 is electrically connected to three data lines D. A column of sub-pixels 10 includes a plurality of groups of sub-pixels 10, and each group of sub-pixels 10 includes three adjacent sub-pixels 10. In the three sub-pixels 10, a first sub-pixel is electrically connected to a first data line D in the three data lines D, a second sub-pixel 10 is electrically connected to a second data line D, and a third sub-pixel 10 is electrically connected to a third data line D.

By such an arrangement, distances between the group of gate scan signal lines G(k) and the n rows of sub-pixels 10 electrically connected thereto are uniform, and connection lines between the gate scan signal lines and the n rows of sub-pixels 10 are short, so that an overlarge resistance caused by an overlong connection line is avoided so as to avoid a voltage drop and signal loss during signal transmission.

Figure 5:
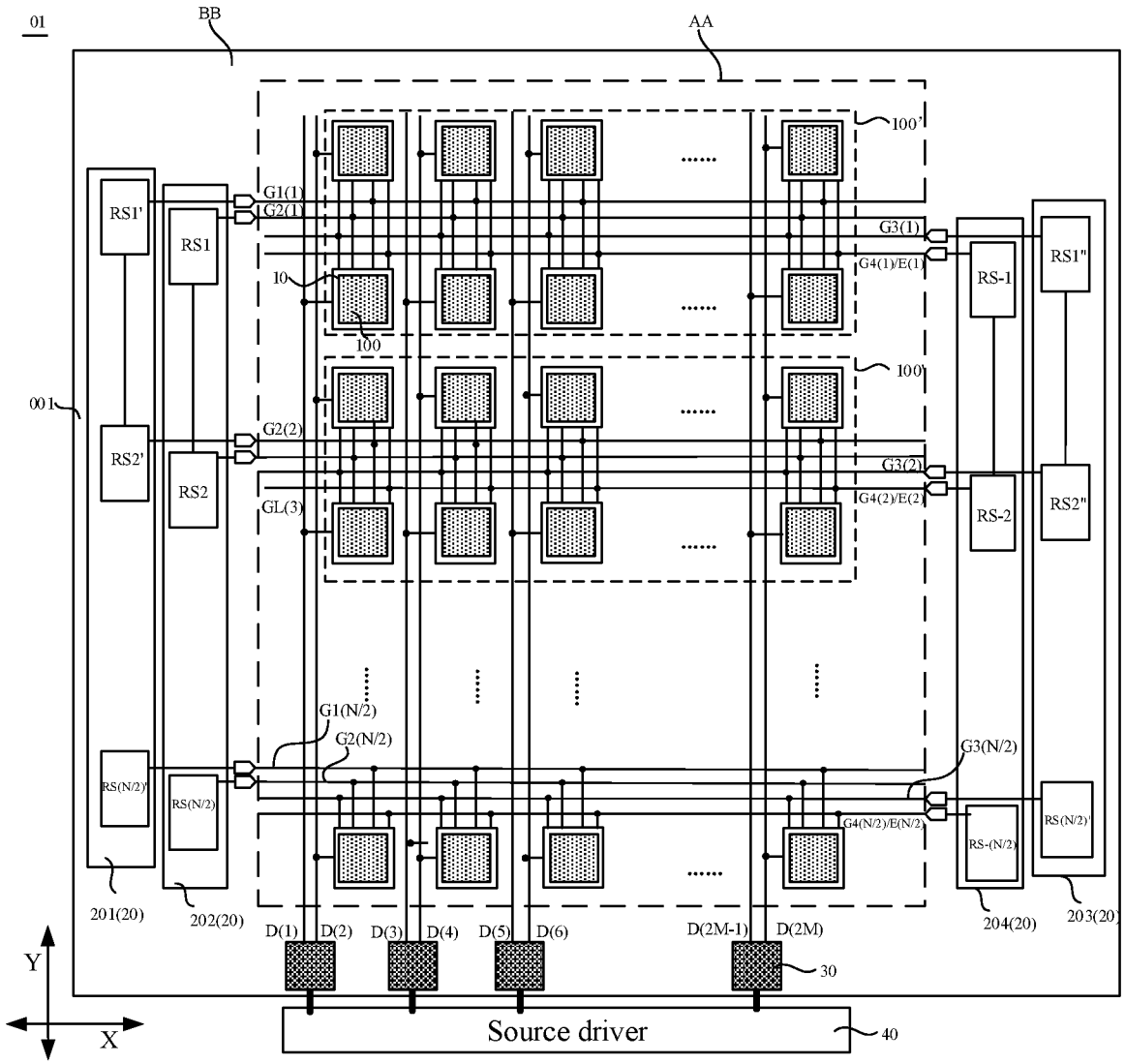
FIG. 5 is a structural diagram of another display substrate, in accordance with some embodiments of the present disclosure.

In some embodiments, as shown in FIGS. 4 and 5, a group of gate scan signal lines G(k) is electrically connected to two adjacent rows of sub-pixels 10. A column of sub-pixels 10 is electrically connected to two data lines D. In a column of sub-pixels 10, an odd-numbered sub-pixel 10 is electrically connected to one of the two data lines D, and an even-numbered sub-pixel 10 is electrically connected to another one of the two data lines D.

Every two adjacent rows of sub-pixels 10 are controlled by the same group of gate scan signal lines G(k), and sub-pixels 10 in odd-numbered rows and sub-pixels 10 in even-numbered rows in a column of sub-pixels 10 are alternately electrically connected to the two data lines DD. In this way, the number of gate scan signal lines G in the display substrate is able to be halved, so that the number of the shift registers included in the gate driving circuit is halved, which is conducive to narrowing the bezel of the display substrate.

In some examples, as shown in FIGS. 4 and 5, each group of gate scan signal lines G(k) is disposed between two adjacent rows of sub-pixels 10 to which this group of gate scan signal lines G(k) is electrically connected.

Each group of gate scan signal lines G(k) is disposed between two adjacent rows of sub-pixels 10 to which this group of gate scan signal lines G(k) is electrically connected, so that distances between each group of gate scan signal lines G(k) and the two rows of sub-pixels 10 are equal or approximately equal, and lengths of connection lines between the gate scan signal lines and the sub-pixels 10 are the same, which may ensure that gate scan signals received by the two rows of sub-pixels 10 are basically the same, so as to improve a brightness stability of the sub-pixels 10 during operation.

In some embodiments, each group of gate scan signal lines G(k) includes a single gate scan signal line G that is electrically connected to corresponding n rows of sub-pixels 10. In some other embodiments, each group of gate scan signal lines G(k) includes two to four gate scan signal lines G, and each gate scan signal line G is electrically connected to corresponding n rows of sub-pixels 10.

In some embodiments, a connection relationship between the at least one gate driving circuit 20 disposed in the peripheral area BB and the plurality of gate scan signal lines G is as follows. Each gate driving circuit 20 includes a plurality of shift registers RS, and each shift register RS is electrically connected to at least one of a group of gate scan signal lines G(k).

In some examples, in a case where each group of gate scan signal lines G(k) includes a single gate scan signal line G, the display substrate 01 includes a single gate driving circuit 20. The gate driving circuit 20 includes a plurality of shift registers RS, and each shift register RS is electrically connected to a gate scan signal line G. In the case where the plurality of sub-pixels 10 are arranged in the N rows and the M columns, the display substrate includes N/n groups of gate scan signal lines, the gate driving circuit includes N/n shift registers RS, and each shift register RS corresponds to n rows of sub-pixel 10.

In some other examples, in a case where each group of gate scan signal lines G(k) includes two to four gate scan signal lines G, for example, as shown in FIGS. 4 to 7, each group of gate scan signal lines G(k) includes a first gate scan signal line G1, a second gate scan signal line G2, a third gate scan signal line G3 and a fourth gate scan signal line G4. The fourth gate scan signal line G4 is a light-emitting timing signal line E.

In this case, as a possible design, as shown in FIG. 5, the display substrate 01 includes four gate driving circuits 20, and each gate driving circuit 20 includes a plurality of shift registers RS. A shift register RS in each gate driving circuit 20 is electrically connected to one of a group of gate scan signal lines G(k).

For example, the four gate driving circuits 20 are a first gate driving circuit 201, a second gate driving circuit 202, a third gate driving circuit 203 and a fourth gate driving circuit 204, respectively. A shift register RS, e.g., RS1', in the first driving circuit 201 is electrically connected to a first gate scan signal line G1(1) in a group of gate scan signal lines G(1), and this shift register RS outputs and transmits a first gate scan signal to the first gate scan signal line G1(1). A shift register RS, e.g., RS1, in the second gate driving circuit 202 is electrically connected to a second gate scan signal line G2(1) in the group of gate scan signal lines G(1), and this shift register RS outputs and transmits a second gate scan signal to the second gate scan signal line G2(1). A shift register RS, e.g., RS1", in the third gate driving circuit 203 is electrically connected to a third gate scan signal line G3(1) in the group of gate scan signal lines G(1), and this shift register RS outputs and transmits a third gate scan signal to the third gate scan signal line G3(1). A shift register RS, e.g., RS-1, in the fourth gate driving circuit 204 is electrically connected to a fourth gate scan signal line G4(1) in the group of gate scan signal lines G(1), and this shift register RS outputs and transmits a fourth gate scan signal to the fourth gate scan signal line G4(1). For example, timing diagrams of the first gate scan signal, the second gate scan signal, the third gate scan signal and the fourth gate scan signal within a frame period may refer to the timing diagrams respectively corresponding to G1, G2, G3, and EM/G4 in FIG. 10. In the case where the plurality of sub-pixels 10 are arranged in the N rows and the M columns, the display substrate 01 includes N/n groups of gate scan signal lines, each gate driving circuit includes N/n shift registers, and each shift register corresponds to n rows of sub-pixels 10.

In the above four gate driving circuits, as an example, the first gate driving circuit 201 and the second gate driving circuit 202 are located on a side of the display area AA, and the third gate driving circuit 203 and the fourth gate driving circuit 204 are located on another side of the display area AA.

As another possible design, as shown in FIG. 7, the display substrate 01 includes three gate driving circuits 20, and each gate driving circuit 20 includes a plurality of shift registers RS. A shift register in one of the three gate driving circuits 20 is electrically connected to two of a group of gate scan signal lines G(k); in another two of the three gate driving circuits, a shift register in each gate driving circuit is electrically connected to one of another two of a group of gate scan signal lines G(k).

For example, as shown in FIG. 7, the three gate driving circuits 20 are a first gate driving circuit 201, a second gate driving circuit 202 and a third gate driving circuit 203, respectively. A shift register RS, e.g., RS1, in the first gate driving circuit 201 is electrically connected to a first gate scan signal line G1(1) and a fourth gate scan signal line G4(1) in the group of gate scan signal lines G(1). For example, the shift register RS in the first gate driving circuit 201 is able to output two identical signals. In some embodiments, the shift register RS in the first gate driving circuit 201 is directly electrically connected to the first gate scan signal line G1(1) in the group of gate scan signal lines G(1), and is electrically connected to the fourth gate scan signal line G4(1) through an inverter 2*a*. That is, the first gate driving circuit 201 includes a plurality of signal output units 2A, and a shift register and an inverter constitute an output unit 2A, so that a fourth gate scan signal received by the fourth gate scan signal line G4 has a phase opposite to that of a first gate scan signal received by the first gate scan signal line G1 by phase inversion of the inverter. Timing diagrams of the first gate scan signal and the fourth gate scan signal within a frame period may refer to the timing diagrams respectively corresponding to G1 and EM/G4 in FIG. 10.

A shift register RS, e.g. RS-1, in the second gate driving circuit 202 is electrically connected to a third gate scan signal line G3(1) in the group of gate scan signal lines G(1), and this shift register RS outputs and transmits a third gate scan signal to the third gate scan signal line G3(1). A shift register RS, e.g., RS1", in the third gate driving circuit 203 is electrically connected to a second gate scan signal line G2(1) in the group of gate scan signal lines G(1), and this shift register RS outputs and transmits a second gate scan signal to the second gate scan signal line G2(1). Timing diagrams of the second gate scan signal and the third gate scan signal within a frame period may refer to the timing diagrams respectively corresponding to G2 and G3 in FIG. 10.

In the case where the plurality of sub-pixels 10 are arranged in the N rows and the M columns, the display substrate 01 includes N/n groups of gate scan signal lines, each gate driving circuit includes N/n shift registers, and each shift register corresponds to n rows of sub-pixels 10.

In the above three gate driving circuits, as an example, the first gate driving circuit 201 is located on a side of the display area AA, and the second gate driving circuit 202 and the third gate driving circuit 203 are located on another side of the display area AA.

Figure 8:
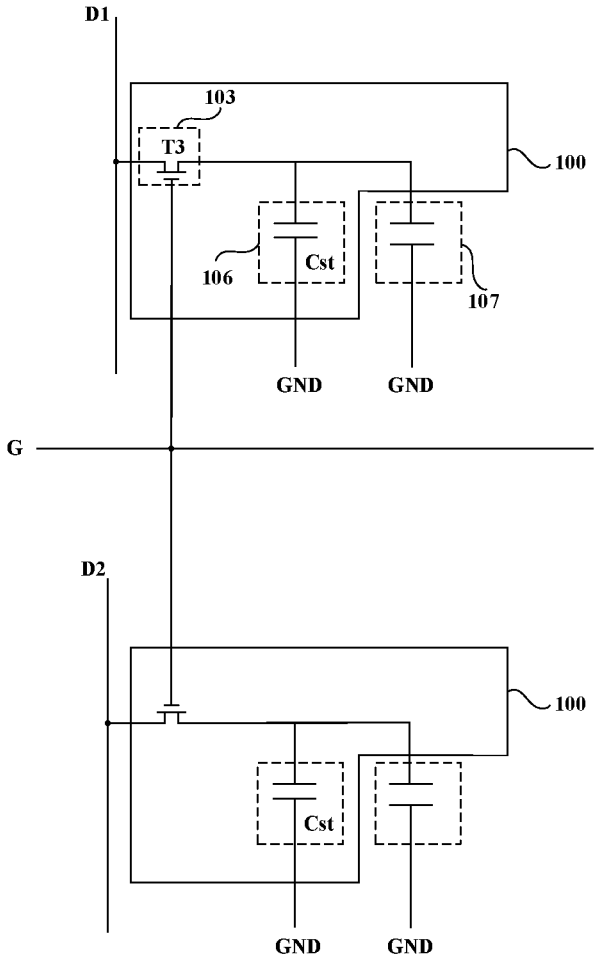
FIG. 8 is a structural diagram showing a gate scan signal line electrically connected to pixel driving circuits in a display substrate, in accordance with some embodiments of the present disclosure.
Figure 9A:
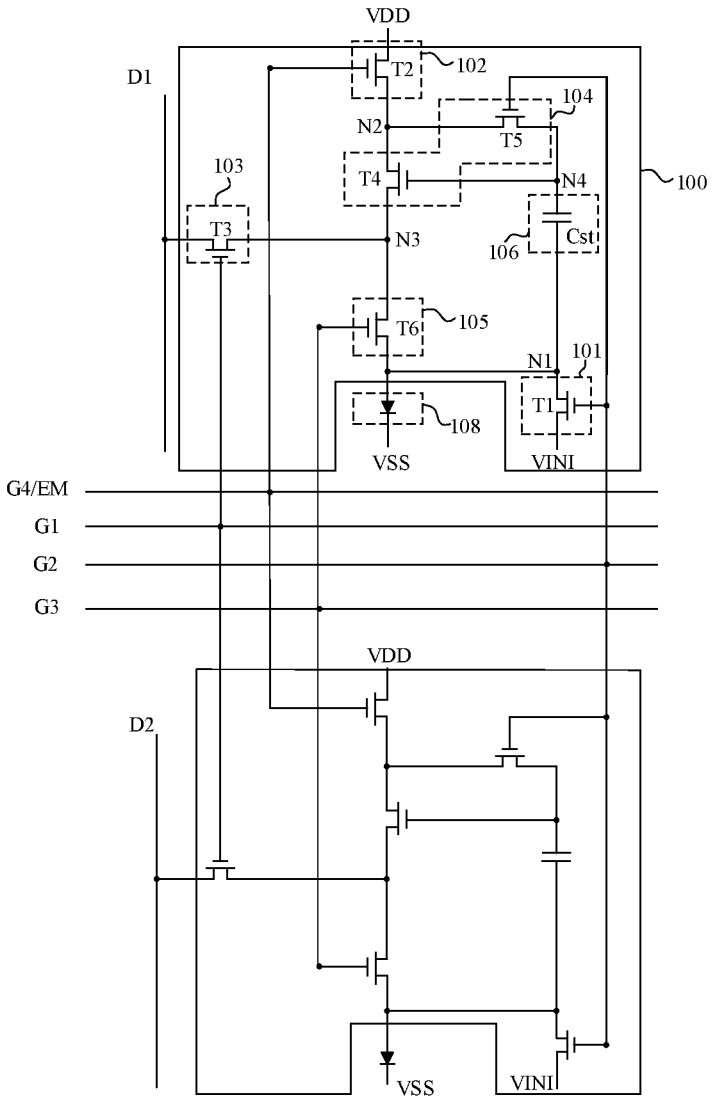
FIG. 9A is another structural diagram showing gate scan signal lines electrically connected to pixel driving circuits in a display substrate, in accordance with some embodiments of the present disclosure.
Figure 9B:
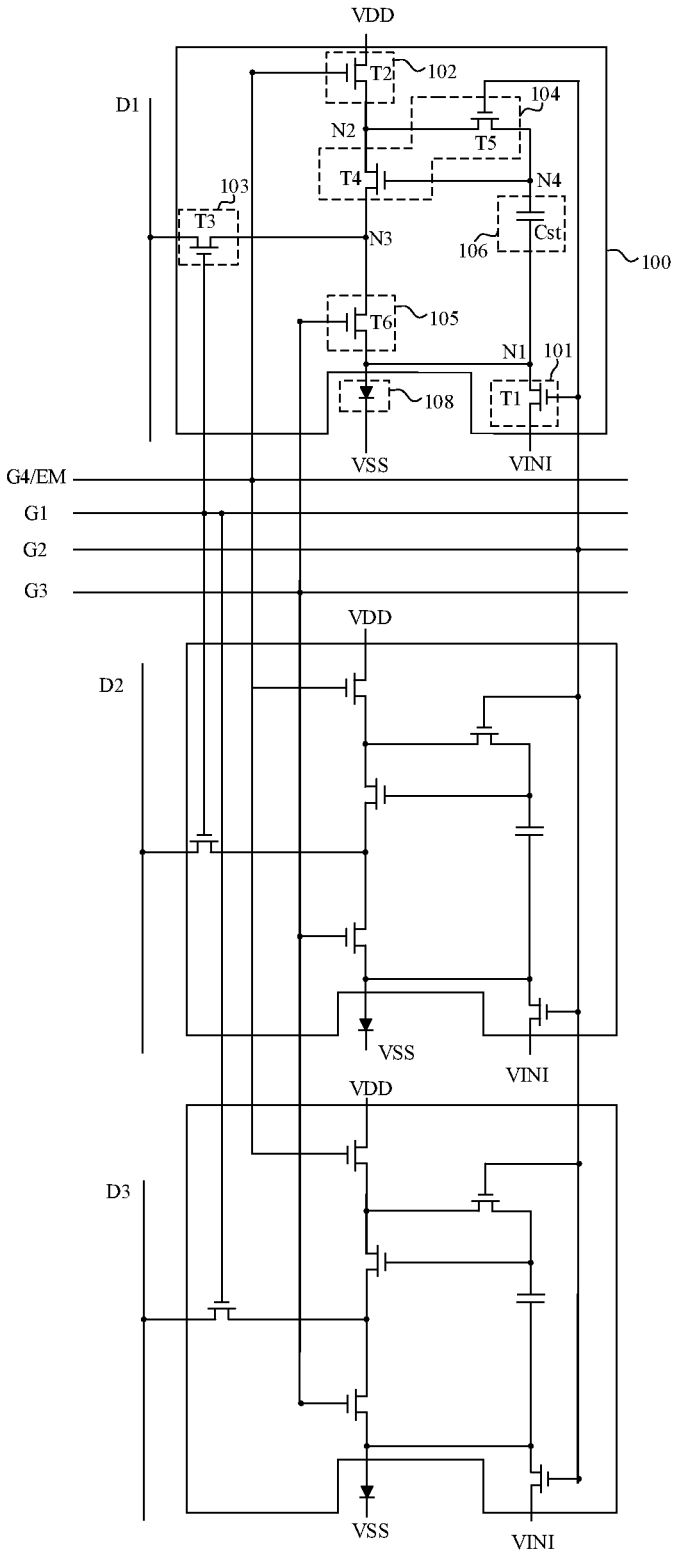
FIG. 9B is yet another structural diagram showing gate scan signal lines electrically connected to pixel driving circuits in a display substrate, in accordance with some embodiments of the present disclosure.

As shown in FIGS. 8, 9A and 9B, in some embodiments, each sub-pixel 10 includes a pixel driving circuit 100. A group of gate scan signal lines G(k) is electrically connected pixel driving circuits 100 in n rows of sub-pixels 10, and a group of data lines D-(k') is electrically connected to pixel driving circuits 100 in a column of sub-pixels 10.

The pixel driving circuit 100 includes a data writing sub-circuit 103.

The data writing sub-circuit 103 is electrically connected to a gate scan signal line G in a group of gate scan signal lines G(k) to which the sub-pixel 10 is electrically connected, and a data line D in a group of data lines D-(k') to which the sub-pixel 10 is electrically connected. The data writing sub-circuit 103 is configured to write a data signal received at the data line into the pixel driving circuit 100 under a control of a gate scan signal transmitted by the gate scan signal line.

In a case where the display substrate is the liquid crystal display substrate, as shown in FIG. 8, the sub-pixel 10 further includes a liquid crystal capacitor 107 electrically connected to the pixel driving circuit 100. The pixel driving circuit 100 further includes a storage sub-circuit 106 in addition to the data writing sub-circuit 103. A group of gate scan signal lines G(k) includes a single gate scan signal line G.

The data writing sub-circuit 103 is further electrically connected to the storage sub-circuit 106 and the liquid crystal capacitor 107. The data writing sub-circuit 103 is configured to write the data signal received at the data line into the storage sub-circuit 106 and the liquid crystal capacitor 107 under the control of the gate scan signal transmitted by the gate scan signal line.

The storage sub-circuit 106 is further electrically connected to a constant voltage terminal and the liquid crystal capacitor 107. The storage sub-circuit 106 is configured to store the data signal and keep a potential of a connection terminal of the storage sub-circuit 106 and the liquid crystal capacitor 107 stable. The constant voltage terminal is, for example, a ground signal terminal GND, or a low voltage signal terminal.

The liquid crystal capacitor 107 is further electrically connected to the constant voltage terminal. The liquid crystal capacitor 107 is configured to form an electric field due to an action of the data signal.

In some embodiments, as shown in FIG. 8, the data writing sub-circuit 103 includes a switching transistor (i.e., a third transistor T3). The storage sub-circuit 106 includes a storage capacitor Cst. The liquid crystal capacitor 107 includes a pixel electrode and a common electrode arranged opposite to each other, and a liquid crystal layer disposed between the pixel electrode and the common electrode.

A control electrode of the switching transistor is electrically connected to the gate scan signal line G, a first electrode of the switching transistor is electrically connected to the data line D, and a second electrode of the switching transistor is electrically connected to a first electrode of the storage capacitor Cst and the pixel electrode of the liquid crystal capacitor 107. The first electrode of the storage capacitor Cst is electrically connected to a connection node. Due to an action of a pixel voltage provided by the switching transistor, the liquid crystal capacitor 107 forms the electric field between the pixel electrode and the common electrode. The electric field is able to control liquid crystal molecules in the liquid crystal layer to deflect, so as to control a state of light passing through a region where the sub-pixel 10 is located, thereby enabling the display substrate to display an image.

In some embodiments, as shown in FIGS. 9A and 9B, in a case where the display substrate 01 is the OLED display substrate 01, the display substrate 01 further includes a plurality of first voltage signal lines VDD, a plurality of second voltage signal line VSS and a plurality of initialization signal lines VINI that are all disposed in the display area AA. For example, the plurality of first voltage signal lines VDD and the plurality of second voltage signal lines VSS extend in the vertical direction Y, and the plurality of initialization signal lines VINI extend in the horizontal direction X. The initialization signal line VINI is configured to transmit an initialization signal.

Each group of gate scan signal lines G(k) includes the first gate scan signal line G1, the second gate scan signal line G2, the third gate scan signal line G3 and the fourth gate scan signal line G4. The first gate scan signal line G1, the second gate scan signal line G2, the third gate scan signal line G3 and the fourth gate scan signal line G4 are all electrically connected to corresponding n rows of sub-pixels 10.

As shown in FIGS. 9A and 9B, the pixel driving circuit 100 in each sub-pixel 10 is electrically connected to a first voltage signal line VDD, a second voltage signal line VSS, an initialization signal line VINI, the first gate scan signal line G1, the second gate scan signal line G2, the third gate scan signal line G3, and the fourth gate scan signal line G4.

The sub-pixel 10 further includes a light-emitting device 108 electrically connected to the pixel driving circuit 100. The light-emitting device 108 is, for example, an organic light-emitting diode. Due to a driving action of the pixel driving circuit 100, the light-emitting device 108 emits light, so that the display substrate 01 displays an image.

In some examples, as shown in FIGS. 9A and 9B, in addition to the data writing sub-circuit 103, the pixel driving circuit 100 further includes a first reset sub-circuit 101, a second reset sub-circuit 102, a driving sub-circuit 104, a light-emitting control sub-circuit 105 and a storage sub-circuit 106.

The first reset sub-circuit 101 is electrically connected to a first node N1, the initialization signal line VINI and the second gate scan signal line G2. The first reset sub-circuit 101 is configured to transmit the initialization signal received at the initialization signal line VINI to the first node N1 under a control of the second gate scan signal transmitted by the second gate scan signal line G2.

For example, the first reset sub-circuit 101 includes a first transistor T1. A control electrode of the first transistor T1 is electrically connected to the second gate scan signal line G2, a first electrode of the first transistor T1 is electrically connected to the initialization signal line VINI, and a second electrode of the first transistor T1 is connected to the first node N1.

The second reset sub-circuit 102 is electrically connected to the first voltage signal line VDD, a second node N2 and the fourth gate scan signal line G4. The second reset sub-circuit 102 is configured to transmit a first voltage signal received at the first voltage signal line VDD to the second node N2 under a control of the fourth gate scan signal transmitted by the fourth gate scan signal line G4.

For example, the second reset sub-circuit 102 includes a second transistor T2. A control electrode of the second transistor T2 is electrically connected to the fourth gate scan signal line G4, a first electrode of the second transistor T2 is electrically connected to the first voltage signal line VDD, and a second electrode of the second transistor T2 is electrically connected to the second node N2.

A gate scan signal line G to which the data writing sub-circuit 103 is electrically connected is the first gate scan signal line G1, and the data writing sub-circuit 103 is further electrically connected to a third node N3. The data writing sub-circuit 103 is configured to transmit the data signal received at the data line to the third node N3 under a control of the first gate scan signal transmitted by the first gate scan signal line G1.

For example, the data writing sub-circuit 103 includes a third transistor T3. A control electrode of the third transistor T3 is electrically connected to the first gate scan signal line G1, a first electrode of the third transistor T3 is electrically connected to the data line, and a second electrode of the third transistors T3 is electrically connected to the third node N3.

The driving sub-circuit 104 is electrically connected to the second node N2, the third node N3, a fourth node N4 and the second gate scan signal line G2. The driving sub-circuit 104 is configured to: transmit the first voltage signal at the second node N2 to the fourth node N4 under a control of the second gate scan signal transmitted by the second gate scan signal line G2; and transmit the data signal at the third node N3 to the fourth node N4, and generate and transmit a driving current to the third node N3 under a control of a voltage of the fourth node N4.

For example, the driving sub-circuit 104 includes a fourth transistor T4 and a fifth transistor T5. A control electrode of the fourth transistor T4 is electrically connected to the fourth node N4, a first electrode of the fourth transistor T4 is electrically connected to the second node N2, and a second electrode of the fourth transistor T4 is electrically connected to the third node N3. A control electrode of the fifth transistor T5 is electrically connected to the second gate scan signal line G2, a first electrode of the fifth transistor T5 is electrically connected to the second node N2, and a second electrode of the fifth transistor T5 is electrically connected to the fourth node N4.

The storage sub-circuit 106 is electrically connected to the first node N1 and the fourth node N4. The storage sub-circuit 106 is configured to store the voltage of the fourth node N4 and a voltage of the first node N1, and to change a potential of the fourth node N4 due to an action of the voltage of the first node N1.

For example, the storage sub-circuit 106 includes a storage capacitor Cst. A first electrode of the storage capacitor Cst is electrically connected to the fourth node N4, and a second electrode of the storage capacitor Cst is electrically connected to the first node N1.

The light-emitting control sub-circuit 105 is electrically connected to the first node N1, the third node N3 and the third gate scan signal line G3. The light-emitting control sub-circuit 105 is configured to transmit the driving current received at the third node N3 to the first node N1 under a control of the third gate scan signal transmitted by the third gate scan signal line G3.

For example, the light-emitting control sub-circuit 105 includes a sixth transistor T6. A control electrode of the sixth transistor T6 is electrically connected to the third gate scan signal line G3, a first electrode of the sixth transistor T6 is electrically connected to the third node N3, and a second electrode of the sixth transistor T6 is electrically connected to the first node N1.

The light-emitting device 108 is electrically connected to the first node N1 and the second voltage signal line VSS. The light-emitting device 108 is configured to emit light under a control of the driving current received at the first node N1. For example, a first electrode of the light-emitting device 108 is electrically connected to the first node N1, and a second electrode of the light-emitting device 108 is electrically connected to the second voltage signal line VSS.

In some embodiments, in the pixel driving circuit 100, the first transistor T1, the second transistor T2, the third transistor T3, the fourth transistor T4, the fifth transistor T5, and the sixth transistor T6 are all P-type transistors, or are all N-type transistors.

In the embodiments of the present disclosure, the specific implementation of the pixel driving circuit 100 is not limited to the above description, and may be any implementation that is used, such as a conventional connection known to those skilled in the art, as long as corresponding functions are ensured to be realized. The above example provides a structural example of the pixel driving circuit 100 of 6T1C. It will be understood that the pixel driving circuit 100 may have a structure of 3T1C or 7T1C, and the above example does not limit the protection scope of the present disclosure. In practical applications, a skilled person may choose to use or not to use one or more of the above circuits according to the situation. Various combination modifications of the above circuits do not depart from the principle of the present disclosure, and will not be repeated here.

Figure 10:
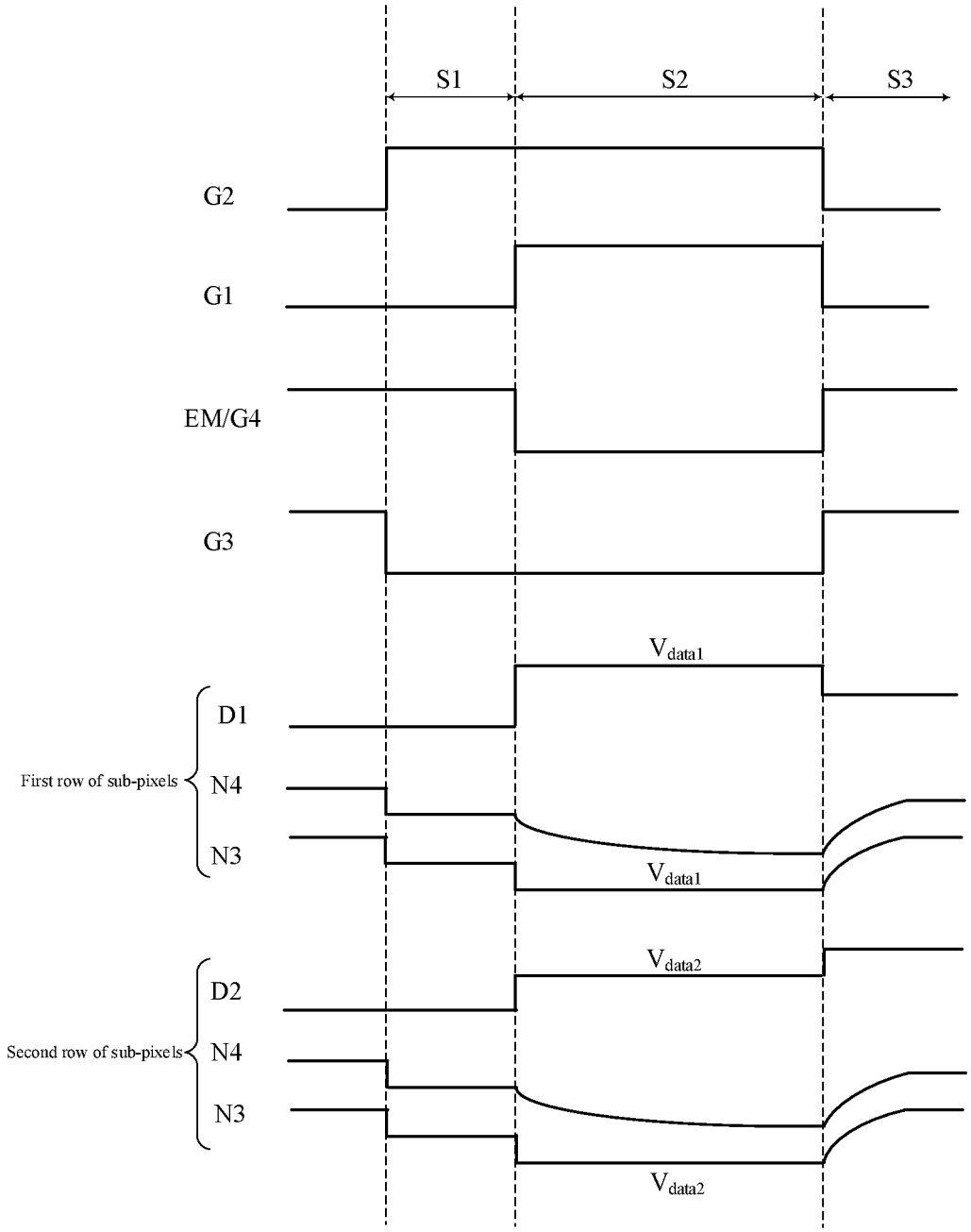
FIG. 10 is a diagram showing driving signals for pixel driving circuits in a display substrate, in accordance with some embodiments of the present disclosure.

Considering the pixel driving circuit 100 shown in FIG. 9A as an example, and the transistors included in the pixel driving circuit 100 are all N-type transistors as an example, a driving process of the pixel driving circuit 100 in each sub-pixel 10 will be described below. As shown in FIG. 10, the driving process is as follows. For a sub-pixel 10, a frame period includes a reset phase S1, a data writing and compensation phase S2, and a light-emitting phase S3.

In the reset phase S1:

A level of the first gate scan signal transmitted by the first gate scan signal line G1 is a low level, a level of the second gate scan signal transmitted by the second gate scan signal line G2 is a high level, a level of the third gate scan signal transmitted by the third gate scan signal line G3 is a low level, and a level of the fourth gate scan signal transmitted by the fourth gate scan signal line G4 is a high level.

The first reset sub-circuit 101 transmits the initialization signal received at the initialization signal line VINI to the first node N1 under the control of the second gate scan signal, so as to reset a potential of the first node N1. The first node N1 is electrically connected to the storage sub-circuit 106 and the light-emitting device 108, and in this case, the storage sub-circuit 106 and the light-emitting device 108 are reset synchronously.

The second reset sub-circuit 102 transmits the first voltage signal received at the first voltage signal line VDD to the second node N2 under the control of the fourth gate scan signal.

The driving sub-circuit 104 transmits the first voltage signal at the second node N2 to the fourth node N4 under the control of the second gate scan signal. Thus, a potential of the second node N2 and a potential of the fourth node N4 are each a potential of the first voltage signal.

In a case where the first reset sub-circuit 101 includes the first transistor T1, the second reset sub-circuit 102 includes the second transistor T2, the data writing sub-circuit 103 includes the third transistor T3, the driving sub-circuit 104 includes the fourth transistor T4 and the fifth transistor T5, the storage sub-circuit 106 includes the storage capacitor Cst, and the light-emitting control sub-circuit 105 includes the sixth transistor T6, in the reset phase S1:

The first transistor T1 is turned on under the control of the second gate scan signal to transmit the initialization signal to the first node N1, so as to reset a potential of the second electrode of the storage capacitor Cst and a potential of the first electrode of the light-emitting device 108. The potential of the second electrode of the storage capacitor Cst is a potential $V_{ini}$ of the initialization signal.

The second transistor T2 is turned on under the control of the fourth gate scan signal to transmit the first voltage signal to the second node N2, so that the potential of the second node N2 is the potential $V_{dd}$ of the first voltage signal.

The fifth transistor T5 is turned on under the control of the second gate scan signal to transmit the first voltage signal at the second node N2 to the fourth node N4, so that the potential of the fourth node N4 is the potential $V_{dd}$ of the first voltage signal. The storage capacitor Cst stores the first voltage signal, and a potential of the first electrode of the storage capacitor Cst is the potential $V_{dd}$ of the first voltage signal.

The fourth transistor T4 is turned on under a control of the voltage of the fourth node N4. Both the third transistor T3 and the sixth transistor T6 are turned off.

In the data writing and compensation phase S2:

The level of the first gate scan signal transmitted by the first gate scan signal line G1 is a high level, the level of the second gate scan signal transmitted by the second gate scan signal line G2 is a high level, the level of the third gate scan signal transmitted by the third gate scan signal line G3 is a low level, and the level of the fourth gate scan signal transmitted by the fourth gate scan signal line G4 is a low level. The data line transmits the data signal with a set voltage.

The data writing sub-circuit 103 transmits the data signal received at the data line to the third node N3 under the control of the first gate scan signal.

The driving sub-circuit 104 transmits the data signal received at the third node N3 to the fourth node N4 under the control of the second gate scan signal. Moreover, the driving sub-circuit 104 discharges to the third node N3 under the control of the voltage of the fourth node N4, and stops discharging until compensation of a threshold voltage of a driving transistor (i.e., the fourth transistor T4) in the driving sub-circuit 104 is completed.

The first reset sub-circuit 101 continues to transmit the initialization signal received at the initialization signal line VINI to the first node N1 under the control of the second gate scan signal, so as to reset the potential of the first node N1. The first node N1 is electrically connected to the storage sub-circuit 106 and the light-emitting device 108, and in this case, the storage sub-circuit 106 and the light-emitting device 108 continue to be reset.

In the case where the first reset sub-circuit 101 includes the first transistor T1, the second reset sub-circuit 102 includes the second transistor T2, the data writing sub-circuit 103 includes the third transistor T3, the driving sub-circuit 104 includes the fourth transistor T4 and the fifth transistor T5, the storage sub-circuit 106 includes the storage capacitor Cst, and the light-emitting control sub-circuit 105 includes the sixth transistor T6, in the data writing and compensation phase S2:

The third transistor T3 is turned on under the control of the first gate scan signal to transmit the data signal received at the data line to the third node N3, and in this case, a potential of the third node N3 is a potential $V_{data}$ of the data signal.

The fourth transistor T4 is turned on under the control of the voltage of the fourth node N4, and the fifth transistor T5 is turned on under the control of the second gate scan signal. The fourth transistor T4 and the fifth transistor T5 transmit the data signal at the third node N3 to the fourth node N4, and the potential of the fourth node N4 starts to be changed until the potential $V_{N4}$ of the fourth node N4 becomes a sum of the potential $V_{N3}$ of the third node N3 and the threshold voltage of the fourth transistor T4. That is, the potential of the fourth node N4 is $V_{N4}=V_{N3}+V_{th}=V_{data}+V_{th}$. At this time, the fourth transistor T4 is turned off.

The storage capacitor Cst stores the potential of the fourth node N4, and the potential of the first electrode of the storage capacitor Cst is $V_{data}+V_{th}$. Thus, the writing of the data signal and the storage of the threshold voltage of the fourth transistor T4 are completed.

The first transistor T1 is turned on under the control of the second gate scan signal, so as to continue to transmit the initialization signal received at the initialization signal line VINI to the first node N1, so that the storage capacitor Cst stores the initialization signal, and the potential of the second electrode is the potential $V_{ini}$ of the initialization signal.

Both the second transistor T2 and the sixth transistor T6 are turned off.

In the light-emitting phase S3:

The level of the first gate scan signal transmitted by the first gate scan signal line G1 is a low level, the level of the second gate scan signal transmitted by the second gate scan signal line G2 is a low level, the level of the third gate scan signal transmitted by the third gate scan signal line G3 is a high level, and the level of the fourth gate scan signal transmitted by the fourth gate scan signal line G4 is a high level. The data line transmits the data signal with a set voltage.

The second reset sub-circuit 102 transmits the first voltage signal received at the first voltage signal line VDD to the second node N2 under the control of the fourth gate scan signal.

The light-emitting control sub-circuit 105 transmits the initialization signal received at the first node N1 to the third node N3 under the control of the third gate scan signal transmitted by the third gate scan signal line G3, so that the driving sub-circuit 104 generates a driving current under a control of a voltage of the third node N3, the voltage of the fourth node N4 and a voltage of the second node N2. The light-emitting control sub-circuit 105 transmits the driving current to the light-emitting device 108, so that the light-emitting device 108 emits light.

In the case where the first reset sub-circuit 101 includes the first transistor T1, the second reset sub-circuit 102 includes the second transistor T2, the data writing sub-circuit 103 includes the third transistor T3, the driving sub-circuit 104 includes the fourth transistor T4 and the fifth transistor T5, the storage sub-circuit 106 includes the storage capacitor Cst, and the light-emitting control sub-circuit 105 includes the sixth transistor T6, in the light-emitting phase S3:

The second transistor T2 is turned on under the control of the fourth gate scan signal to transmit the first voltage signal received at the first voltage signal line VDD to the second node N2, so that the potential of the second node N2 is the potential of the first voltage signal.

The sixth transistor T6 is turned on under the control of the third gate scan signal to transmit the initialization signal at the first node N1 to the third node N3, so that the potential of the third node N3 is changed from the potential of the data signal to the potential of the initialization signal. Thus, a voltage difference between a gate and a source of the fourth transistor T4 is greater than the threshold voltage thereof, so that the fourth transistor T4 is turned on. The fourth transistor T4 generates the driving current under the control of the voltage of the third node N3, the voltage of the fourth node N4 and the voltage of the second node N2. The fifth transistor T5 transmits the driving current to the light-emitting device 108, so that the light-emitting device 108 emits light.

In a light-emitting process of the light-emitting device 108, the potential of the first node N1 is equal to the potential $V_{oled}$ of the first electrode of the light-emitting device 108, and a voltage variation of the first node N1 is $\Delta V_{N1}=V_{oled}-V_{ini}$, so that a voltage variation of the second electrode of the storage capacitor Cst is also $\Delta V_{N1}$. Due to a bootstrap action of the capacitor, a voltage variation of the first electrode of the storage capacitor Cst is $\Delta V_{N1}$, so that the potential of the fourth node N4 is $V_{N4}=V_{data}+V_{th}+\Delta V_{N1}$. That is, a potential of the control electrode (i.e., gate) of the fourth transistor T4 is $V_{N4}=V_{data}+V_{th}+\Delta V_{N1}$. A potential of the second electrode (i.e., source) of the fourth transistor T4 is $V_{oled}$.

Thus, the driving current (i.e., a current $I_{oled}$ input to the light-emitting device 108) generated by the fourth transistor T4 is as follows:

$$I_{oled}=\frac{W}{2L}\times\mu\times C_{ox}(V_{gs}-V_{th})^2=\frac{W}{2L}\times\mu\times C_{ox}(V_{data}+V_{th}+\Delta V_{N1}-V_{oled}-V_{th})^2=\frac{W}{2L}\times\mu\times C_{ox}(V_{data}+V_{th}+V_{oled}-V_{ini}-V_{oled}-V_{th})^2=\frac{W}{2L}\times\mu\times C_{ox}(V_{data}-V_{ini})^2$$

W/L is a channel width-to-length ratio of the fourth transistor T4; μ is a carrier mobility; $C_{ox}$ is a channel capacitance per unit area of the fourth transistor T4; $V_{gs}$ is the voltage difference between the gate and the source of the fourth transistor T4; and $V_{th}$ is the threshold voltage of the fourth transistor T4.

It can be seen that the current $I_{oled}$ input to the light-emitting device 108 is related to the potential $V_{data}$ of the written data signal and the initialization signal, and is unrelated to the threshold voltage $V_{th}$ of the fourth transistor T4. Therefore, the driving current generated by the fourth transistor T4 is not affected by the threshold voltage, so that the driving current is prevented from being affected by the difference of the threshold voltage of the fourth transistor T4 caused by the manufacturing process, and thus the display effect is prevented from being affected.

The above driving process of the pixel driving circuit 100 is a driving process of a pixel driving circuit 100 in a sub-pixel 10 within a frame period. For the pixel driving circuits shown in FIG. 9A or 9B, driving processes of pixel driving circuits 100 in the n rows of sub-pixels 10 electrically connected to the same group of gate scan signal lines G(k) are the same, and the driving processes each include the reset phase S1, the data writing and compensation phase S2 and the light-emitting phase S3. For each sub-pixel 10, the data signal written in the data writing and compensation phase S2 depends on a data signal transmitted by a signal line electrically connected thereto, so as to emit light with a corresponding brightness and realize gray scale display. For example, referring to FIGS. 9A and 10, a first group of sub-pixels in a first column of sub-pixels includes two sub-pixels, and the two sub-pixels are electrically connected to a group of gate scan signal lines, and are respectively electrically connected to a data line D1 and a data line D2. Driving processes of pixel driving circuits 100 in the two sub-pixels are the same. In the data writing and compensation phase S2, a voltage $V_{data1}$ of a data signal transmitted by the data line D1 is written into a first sub-pixel, and a voltage $V_{data2}$ of a data signal transmitted by the data line D2 is written into a second sub-pixel.

As shown in FIGS. 3, 5 and 7, the display device 1000 further includes a source driver 40 electrically connected to the plurality of groups of data lines D in the display substrate 01. The source driver 40 is configured to output data signals to control the display substrate 01 for display.

The source driver 40 includes a plurality of output ports each electrically connected to a data line D. That is, the number of the output ports of the source driver 40 is the same as the number of data lines D, so that each output port outputs and transmits a corresponding data signal to a corresponding data line.

As a possible design, the display substrate 01 further includes a plurality of data selectors 30 disposed in the peripheral area BB, and each data selector 30 is electrically connected to n data lines D to which a column of sub-pixels 10 is electrically connected. Each data selector is further coupled to an output port of the source driver 40.

As shown in FIG. 5, the display substrate 01 further includes the plurality of data selectors 30 disposed in the peripheral area BB. Each data selector 30 is electrically connected to two data lines D to which a column of sub-pixels 10 is electrically connected, and is further electrically connected to an output port of the source driver 40. Thus, the display substrate 01 includes 2M data lines, and the 2M data lines are M groups of data lines. The display substrate 01 includes M data selectors 30.

In this case, in a frame period, when a group of gate scan signal lines scans n rows of sub-pixels, a data signal output from an output port of the source driver 40 includes n different voltages, and the n voltages respectively correspond to n sub-pixels coupled to n data lines to which the output port is coupled. For the driving process of the pixel driving circuit shown in FIGS. 9A and 10, it is assumed that a duration of the writing and compensation phase S2 is T in a case where the data selector is not provided, and the duration of the data writing and compensation phase S2 is extended to n times T in a case where the data selector is provided. In each T, the data selector sequentially transmits the voltages of the data signals to corresponding data lines, so as to write a specific voltage of the data signal into a corresponding sub-pixel.

In the above display device, a column of sub-pixels 10 is electrically connected to n data lines D. That is, for the plurality of sub-pixels 10 arranged in the N rows and the M columns, n times M data lines D are required in total. By providing the plurality of data selectors, for example, by providing M data selectors, the number of the corresponding output ports of the source driver 40 is the same as the number of data selectors, and both are M, so that the number of the output ports of the source driver 40 may be reduced, so as to avoid an increase in cost caused by excessive output ports of the source driver 40.

A driving method of a display substrate 01 is further provided. As shown in FIG. 5, in the above display substrate 01, the n rows of sub-pixels 10 to which each group of gate scan signal lines G(k) is electrically connected are a driving unit 100', and the display substrate 01 includes N/n driving units 100'.

The driving method of the display substrate 01 includes following steps.

Gate scan signals are transmitted, via each group of gate scan signal lines G(k) to n rows of sub-pixels 10 included in a driving unit 100' to which this group of gate scan signal lines G(k) is electrically connected.

The n rows of sub-pixels 10 included in each driving unit 100' operate synchronously under a control of the gate scan signals.

The sub-pixel 10 operates, which means that in the case where the display substrate 01 is the liquid crystal display substrate 01, the data signal is written into the sub-pixel 10 under the control of the gate scan signals, and the electric field is formed according to the data signal, so that the liquid crystal molecules in the liquid crystal layer deflect due to an action of the electric field, so as to control light to pass through the region where the sub-pixel 10 is located.

In the case where the display substrate 01 is the OLED display substrate 01, the sub-pixel 10 is controlled by the gate scan signals for reset, writing of data signal and compensation of threshold voltage, so as to generate the driving current and control the light-emitting device to emit light.

The sub-pixels 10 in the driving units 100' are sequentially controlled to operate via the plurality of groups of gate scan signal lines.

Thus, according to an order of the plurality of groups of gate scan signal lines, the sub-pixels 10 in the driving units 100' operate in sequence, and the sub-pixels 10 in each driving unit 100' operate synchronously.

In a case where each group of gate scan signal lines G(k) transmits the gate scan signals to the n rows of sub-pixels 10 included in the driving unit to which the group of gate scan signal lines G(k) is electrically connected, and the n rows of sub-pixels 10 are n adjacent rows of sub-pixels 10, the driving method of the display substrate 01 is different from the row-by-row scanning in the related art, and may be understood as n-row scanning. Every n rows of sub-pixels 10 operate under a control of a group of gate scan signal lines G(k), and the sub-pixels 10 in the driving units emit light in sequence from top to bottom. In the case where n is 2, every 2 rows of sub-pixels 10 are a driving unit, the sub-pixels 10 in the driving units emit light in sequence, and the sub-pixels 10 in each driving unit 100' emit light synchronously.

In each sub-pixel 10, the driving process of the pixel driving circuit 100 may refer to the foregoing description, and will not be repeated here.

In some embodiments, since each group of gate scan signal lines G(k) is electrically connected to the n rows of sub-pixels 10, under a premise that the number of the sub-pixels 10 included in the display substrate 01 is unchanged, for example, the plurality of sub-pixels 10 are arranged in the N rows and the M columns, compared with the row-by-row scanning in the related art in which a total driving duration of each row of sub-pixels 10 within a frame period is, for example, T1, and a voltage change frequency of a data signal transmitted by a corresponding data line electrically connected to a column of sub-pixels 10 is P, in the n-row scanning provided in some embodiments of the present disclosure, a duration of a frame period is unchanged, and a total driving duration of each driving unit within a frame period is, for example, n times T1, i.e., the total driving duration becomes n times the original total driving duration T1. Therefore, a voltage change frequency of a data signal output from the source driver 40 becomes 1/n of the original voltage change frequency P.

The foregoing descriptions are only specific implementations of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

What is claimed is:

1. A display substrate having a display area and a peripheral area located on at least one side of the display area; the display substrate comprising:

a plurality of sub-pixels, a plurality of groups of gate scan signal lines, and a plurality of groups of data lines that are all disposed in the display area; wherein each of the plurality of groups of gate scan signal lines includes at least one gate scan signal line, each of the plurality of groups of data lines includes n data lines, and the plurality of sub-pixels are arranged in an array; wherein n is greater than or equal to 2;

wherein a single group of gate scan signal lines is electrically connected to n rows of sub-pixels; and a column of the plurality of sub-pixels is electrically connected to a group of data lines;

wherein the column of the plurality of sub-pixels includes a plurality of groups of sub-pixels, and a group of the plurality of groups of sub-pixels includes n sub-pixels;

wherein the n sub-pixels are respectively electrically connected to n data lines in the group of data lines to which the column of the plurality of sub-pixels is electrically connected, wherein a sub-pixel includes a pixel driving circuit; the single group of gate scan signal lines is electrically connected to pixel driving circuits in the n rows of sub-pixels, and the group of data lines is electrically connected to pixel driving circuits in the column of the plurality of sub-pixels, wherein the pixel driving circuit includes a data writing sub-circuit, wherein the data writing sub-circuit is electrically connected to a gate scan signal line in a group of gate scan signal lines to which the sub-pixel is electrically connected, and a data line in a group of data lines to which the sub-pixel is electrically connected; and the data writing sub-circuit is configured to write a data signal received at the data line into the pixel driving circuit under a control of a gate scan signal transmitted by the gate scan signal line, wherein the display substrate further comprises a plurality of first voltage signal lines, a plurality of second voltage signal lines and a plurality of initialization signal lines that are all disposed in the display area, wherein each of the plurality of groups of gate scan signal lines includes a first gate scan signal line, a second gate scan signal line, a third gate scan signal line and a fourth gate scan signal line; and the first gate scan signal line, the second gate scan signal line, the third gate scan signal line and the fourth gate scan signal line are electrically connected to corresponding n rows of sub-pixels; and the pixel driving circuit in the sub-pixel is electrically connected to the first voltage signal line, the second voltage signal line, the initialization signal line, and a first gate scan signal line, a second gate scan signal line, a third gate scan signal line and a fourth gate scan signal line that are included in a group of gate scan signal line connected to the sub-pixel, wherein the sub-pixel further includes a light-emitting device electrically connected to the pixel driving circuit, and wherein the pixel driving circuit further includes a first reset sub-circuit, a second reset sub-circuit, a driving sub-circuit, a light-emitting control sub-circuit and a storage sub-circuit; wherein the first reset sub-circuit is electrically connected to a first node, the initialization signal line and the second gate scan signal line; and the first reset sub-circuit is configured to transmit an initialization signal received at the initialization signal line to the first node under a control of a second gate scan signal transmitted by the second gate scan signal line;

the second reset sub-circuit is electrically connected to the first voltage signal line, a second node and the fourth gate scan signal line; and the second reset sub-circuit is configured to transmit a first voltage signal received at the first voltage signal line to the second node under a control of a fourth gate scan signal transmitted by the fourth gate scan signal line;

the gate scan signal line to which the data writing sub-circuit is electrically connected is the first gate scan signal line, and the data writing sub-circuit is further electrically connected to a third node; and the data writing sub-circuit is configured to transmit the data signal received at the data line to the third node under a control of a first gate scan signal transmitted by the first gate scan signal line;

the driving sub-circuit is electrically connected to the second node, the third node, a fourth node and the second gate scan signal line; and the driving sub-circuit is configured to: transmit the first voltage signal at the second node to the fourth node under the control of the second gate scan signal transmitted by the second gate scan signal line; and transmit the data signal at the third node to the fourth node, and generate and transmit a driving current to the third node under a control of a voltage of the fourth node;

the storage sub-circuit is electrically connected to the first node and the fourth node; and the storage sub-circuit is configured to store the voltage of the fourth node and a voltage of the first node, and to change a potential of the fourth node due to an action of the voltage of the first node;

the light-emitting control sub-circuit is electrically connected to the first node, the third node and the third gate scan signal line; and the light-emitting control sub-circuit is configured to transmit the driving current received at the third node to the first node under a control of a third gate scan signal transmitted by the third gate scan signal line; and the light-emitting device is electrically connected to the first node and the second voltage signal line; and the light-emitting device is configured to emit light under a control of the driving current received at the first node.

2. The display substrate according to claim 1, wherein every n adjacent rows of sub-pixels are electrically connected to a group of gate scan signal lines;

wherein in the column of the plurality of sub-pixels, the n sub-pixels included in the group of the plurality of groups of sub-pixels are n adjacent sub-pixels, and wherein an i-th sub-pixel in the n sub-pixels is electrically connected to an i-th data line in the n data lines to which the column of the plurality of sub-pixels is electrically connected; wherein i is greater than or equal to 1 and less than or equal to n.

3. The display substrate according to claim 2, wherein the single group of gate scan signal lines is electrically connected to two adjacent rows of sub-pixels; and the column of the plurality of sub-pixels is electrically connected to two data lines;

wherein in the column of the plurality of sub-pixels, an odd-numbered sub-pixel is electrically connected to one of the two data lines, and an even-numbered sub-pixel is electrically connected to another one of the two data lines.

4. The display substrate according to claim 1, wherein the single group of gate scan signal lines is electrically connected to two adjacent rows of sub-pixels;

wherein the column of the plurality of sub-pixels is electrically connected to two data lines; and wherein in the column of the plurality of sub-pixels, an odd-numbered sub-pixel is electrically connected to one of the two data lines, and an even-numbered sub-pixel is electrically connected to another one of the two data lines.

5. The display substrate according to claim 4, wherein the single group of gate scan signal lines is disposed between the two adjacent rows of sub-pixels to which the single group of gate scan signal lines is electrically connected.

6. The display substrate according to claim 1, wherein the first reset sub-circuit includes a first transistor; a control electrode of the first transistor is electrically connected to the second gate scan signal line, a first electrode of the first transistor is electrically connected to the initialization signal line, and a second electrode of the first transistor is connected to the first node;

the second reset sub-circuit includes a second transistor; a control electrode of the second transistor is electrically connected to the fourth gate scan signal line, a first electrode of the second transistor is electrically connected to the first voltage signal line, and a second electrode of the second transistor is electrically connected to the second node;

the data writing sub-circuit includes a third transistor; a control electrode of the third transistor is electrically connected to the first gate scan signal line, a first electrode of the third transistor is electrically connected to the data line, and a second electrode of the third transistor is electrically connected to the third node;

the driving sub-circuit includes a fourth transistor and a fifth transistor; a control electrode of the fourth transistor is electrically connected to the fourth node, a first electrode of the fourth transistor is electrically connected to the second node, and a second electrode of the fourth transistor is electrically connected to the third node; a control electrode of the fifth transistor is electrically connected to the second gate scan signal line, a first electrode of the fifth transistor is electrically connected to the second node, and a second electrode of the fifth transistor is electrically connected to the fourth node;

the storage sub-circuit includes a storage capacitor; a first electrode of the storage capacitor is electrically connected to the fourth node, and a second electrode of the storage capacitor is electrically connected to the first node;

the light-emitting control sub-circuit includes a sixth transistor; a control electrode of the sixth transistor is electrically connected to the third gate scan signal line, a first electrode of the sixth transistor is electrically connected to the third node, and a second electrode of the sixth transistor is electrically connected to the first node; and a first electrode of the light-emitting device is electrically connected to the first node, and a second electrode of the light-emitting device is electrically connected to the second voltage signal line.

7. The display substrate according to claim 1, further comprising at least one gate driving circuit disposed in the peripheral area; wherein each of the at least one gate driving circuit includes a plurality of shift registers, and each of the plurality of shift registers is electrically connected to at least one gate scan signal line in a group of gate scan signal lines.

8. The display substrate according to claim 7, wherein the at least one gate driving circuit includes four gate driving circuits, and a shift register in each of the four gate driving circuits is electrically connected to a gate scan signal line.

9. The display substrate according to claim 7, wherein the at least one gate driving circuit includes three gate driving circuits;

wherein a shift register in one gate driving circuit of the three gate driving circuits is electrically connected to two of the first gate scan signal line, the second gate scan signal line, the third gate scan signal line and the fourth gate scan signal line; and in another two of the three gate driving circuits, a shift register in each gate driving circuit is electrically connected to one of another two of the first gate scan signal line, the second gate scan signal line, the third gate scan signal line and the fourth gate scan signal line.

10. The display substrate according to claim 9, wherein the shift register in the one gate driving circuit outputs two identical signals; and the shift register in the one gate driving circuit is directly electrically connected to one of the two of the first gate scan signal line, the second gate scan signal line, the third gate scan signal line and the fourth gate scan signal line, and is electrically connected to another one of the first gate scan signal line, the second gate scan signal line, the third gate scan signal line and the fourth gate scan signal line through an inverter.

11. The display substrate according to claim 1, further comprising:

a plurality of data selectors disposed in the peripheral area;

wherein each of the plurality of data selectors is electrically connected to n data lines to which a column of sub-pixels is electrically connected.

12. A display device comprising the display substrate according to claim 1.

13. The display device according to claim 12, further comprising a source driver electrically connected to the plurality of groups of data lines in the display substrate.

14. A driving method of a display substrate, for driving the display substrate according to claim 1, wherein the n rows of sub-pixels electrically connected to the single group of gate scan signal lines make up a driving unit;

the driving method of the display substrate comprises:

transmitting, via each of the single group of gate scan signal lines, gate scan signals to the n rows of sub-pixels included in the driving unit to which the single group of gate scan signal lines is electrically connected, so that the n rows of sub-pixels included in the driving unit operate synchronously under a control of the gate scan signals; and sequentially controlling, via the plurality of groups of gate scan signal lines, sub-pixels in a plurality of driving units to operate, wherein transmitting, via each of the single group of gate scan signal lines, the gate scan signals to the n rows of sub-pixels included in the driving unit to which the single group of gate scan signal lines is electrically connected, so that the n rows of sub-pixels included in the driving unit operate synchronously under the control of the gate scan signals, including:

in a reset phase:

the first reset sub-circuit transmits the initialization signal received at the initialization signal line to the first node under the control of the second gate scan signal transmitted by the second gate scan signal line, so as to reset a potential of the first node;

the second reset sub-circuit transmits the first voltage signal received at the first voltage signal line to the second node under the control of the fourth gate scan signal transmitted by the fourth gate scan signal line; and the driving sub-circuit transmits the first voltage signal at the second node to the fourth node under the control of the second gate scan signal transmitted by the second gate scan signal line;

in a data writing and compensation phase:

the data writing sub-circuit transmits the data signal received at the data line to the third node under the control of the first gate scan signal transmitted by the first gate scan signal line;

the driving sub-circuit transmits the data signal received at the third node to the fourth node under the control of the second gate scan signal; and the first reset sub-circuit continues to transmit the initialization signal received at the initialization signal line to the first node under the control of the second gate scan signal, so as to reset the potential of the first node; and in a light-emitting phase:

the second reset sub-circuit transmits the first voltage signal received at the first voltage signal line to the second node under the control of the fourth gate scan signal transmitted by the fourth gate scan signal line; and the light-emitting control sub-circuit transmits the initialization signal received at the first node to the third node under the control of the third gate scan signal transmitted by the third gate scan signal line, so that the driving sub-circuit generates the driving current under control of a voltage of the third node, the voltage of the fourth node and a voltage of the second node; the light-emitting control sub-circuit transmits the driving current to the light-emitting device, so that the light-emitting device emits light.

* * * * *